US006929905B2

(12) United States Patent
Gordon et al.

(10) Patent No.: US 6,929,905 B2
(45) Date of Patent: Aug. 16, 2005

(54) METHOD OF PROCESSING A PHOTOGRAPHIC ELEMENT CONTAINING ELECTRON TRANSFER AGENT RELEASING COUPLERS

(75) Inventors: Stuart T. Gordon, Rochester, NY (US); Sharon R. Lunt, Webster, NY (US); David T. Southby, Rochester, NY (US); Robert A. Arcus, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 337 days.

(21) Appl. No.: 10/028,132

(22) Filed: Dec. 20, 2001

(65) Prior Publication Data

US 2003/0175628 A1 Sep. 18, 2003

(51) Int. Cl.[7] ..... G03C 7/407
(52) U.S. Cl. ..... 430/361
(58) Field of Search ..... 430/361

(56) References Cited

U.S. PATENT DOCUMENTS

| | | | | |
|---|---|---|---|---|
| 4,859,578 | A | 8/1989 | Michno et al. | 430/544 |
| 4,892,804 | A | 1/1990 | Vincent et al. | 430/380 |
| 4,912,025 | A | 3/1990 | Platt et al. | 430/544 |
| 5,605,786 | A | 2/1997 | Saito et al. | 430/553 |
| 5,830,627 | A | 11/1998 | Nakai et al. | 430/505 |
| 5,932,399 | A | 8/1999 | Tsoi et al. | 430/434 |
| 5,972,584 | A | 10/1999 | Tsoi et al. | 430/483 |
| 6,020,112 | A | 2/2000 | Twist | 430/380 |
| 6,110,657 | A | 8/2000 | Lunt et al. | 430/546 |
| 6,114,103 | A | 9/2000 | Friday et al. | 430/546 |

FOREIGN PATENT DOCUMENTS

| | | |
|---|---|---|
| EP | 1 011 026 | 6/2000 |
| EP | 1 111 458 A1 | 6/2001 |
| EP | 1 199 599 | 4/2002 |
| EP | 1 199 600 | 4/2002 |

*Primary Examiner*—Hoa Van Le
(74) *Attorney, Agent, or Firm*—Sarah Meeks Roberts

(57) ABSTRACT

A method of processing a silver bromoiodide photographic element comprising contacting the photographic element with a color developer for less than 120 seconds; wherein the photographic element comprises a support and more than one dye forming unit, and wherein the dye forming unit closest to the support contains an electron transfer agent releasing compound represented by the formula:

$$CAR\text{-}(L)_n\text{-}ETA$$

wherein:

CAR is a carrier moiety which is capable of releasing -(L)n-ETA on reaction with oxidized developing agent;

L is a divalent linking group, n is 0, 1, or 2; and

ETA is a releasable 1-aryl-3-pyrazolidinone electron transfer agent having a calculated log partition coefficient (c log P) greater than or equal to 2.40 bonded to L or CAR through either the nitrogen atom in the 2-position or the oxygen attached to the 3-position of the pyrazolidinone ring.

21 Claims, No Drawings

METHOD OF PROCESSING A PHOTOGRAPHIC ELEMENT CONTAINING ELECTRON TRANSFER AGENT RELEASING COUPLERS

FIELD OF THE INVENTION

This invention relates to a method of processing a silver halide photographic element containing a compound that releases an electron transfer agent (ETARC) capable of selective development acceleration for improved photographic imaging.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions and automatic processing machines. Photographic color developing compositions are used to provide the desired dye images early in the photoprocessing method. Such compositions generally contain color developing agents, for example, 4-amino-3-methyl-N-(2-methane sulfonamidoethyl)aniline, as reducing agents to react with suitable color forming couplers to form the desired dyes Traditionally, the color development process has required one or two days for providing the customer with the desired prints. In recent years, customers have wanted faster service, and in some locations known as "mini-labs", it is desired to provide the customer with the desired prints within an hour. This requires the photoprocessing methods to be even faster, and reducing the processing time to within a few minutes is the ultimate desire in the industry. Much effort has been directed towards co-optimizing photographic film/paper and processes for very short processing times of two minutes or less.

Reduction in processing time of the "display" elements or color photographic papers has been facilitated by a number of recent innovations, including the use of predominantly silver chloride emulsions in the display elements. U.S. Pat. No. 4,892,804 (Vincent et al) describes conventional color developing compositions for use with high chloride photographic elements that have found considerable commercial success in the photographic industry.

Color negative films, however, generally comprise little or no silver chloride in their emulsions, and generally have silver bromide as the predominant silver halide. More typically, the emulsions are silver bromoiodide emulsions with silver iodide levels up to several mol percent. Such films require these types of emulsions because emulsions containing high silver chloride have not demonstrated sufficient light sensitivity to be used as camera speed materials although they have the advantage of being rapidly processed without major changes to the color developer solution.

When color negative films are processed using a development time of less than 120 seconds, non-neutral changes in color balance result. Specifically, the bottom layer is impacted more than the top layer so a film that yields balanced contrast between layers in a standard development cycle will produce unwanted contrast mismatches when processed through a shortened development time.

Methods to accelerate development of exposed silver halide grains, which enable higher photographic response with smaller silver halide grains and/or lower granularity, have been realized. For example, U.S. Pat. No. 4,912,025 describes the release of electron transfer agents (ETAs) for development acceleration without a concomitant granularity and fog increase. These type of compounds are commonly referred to as electron transfer agent releasing couplers or ETARCs. More recently, U.S. Pat. No. 5,605,786 describes a method of imagewise release of an ETA where an —O—CO—$(T)_n$-(ETA) group is attached at the coupling-off site of the ETARC. In addition, U.S. Pat. No. 4,859,578 describes 1-aryl-3-pyrazolidinone ETAs in combination with a SMRC. Such compounds, however, are not record selective so this would not alleviate the contrast mismatch problem. The use of non-ballasted ETARCs often result in higher contrast in adjacent layers. A class of ballasted ETARCs is described in U.S. Pat. Nos. 6,110,657 of Lunt et al; U.S. Pat. No. 6,114,103 of Friday et al; and EP 1 111 458 A1 (published Jun. 27, 2001). None of these disclosures, however, utilizes electron transfer agents with shortened processing times.

U.S. Pat. Nos. 5,972,584 and 5,932,399 describe the use of certain electron transfer agents contained in the developer solution or coated in the film. U.S. Pat. No. 6,020,112 describes the use of electron transfer agents in shortened processing times when utilized in high chloride silver halide emulsions. U.S. Pat. No. 5,830,627 describes the use of a blocked electron transfer agent and a rapid processing cycle. When processed through a rapid developer containing a special additive, the electron transfer agent is released in a non-imagewise fashion and provides improved developability in the coated layer.

There is still a need for a method of developing films using rapid processing which does not result in unwanted contrast mismatches in the developed film.

SUMMARY OF THE INVENTION

This invention provides a method of processing a silver bromoiodide photographic element comprising contacting the photographic element with a color developer for less than 120 seconds; wherein the photographic element comprises a support and more than one dye forming unit, and wherein the dye forming unit closest to the support contains an electron transfer agent releasing compound represented by the formula:

$$\text{CAR-(L)}_n\text{-ETA}$$

wherein:

CAR is a carrier moiety which is capable of releasing -(L)n-ETA on reaction with oxidized developing agent;

L is a divalent linking group, n is 0, 1 or 2; and

ETA is a releasable 1-aryl-3-pyrazolidinone electron transfer agent having a calculated log partition coefficient (c log P) greater than or equal to 2.40 bonded to L or CAR through either the nitrogen atom in the 2-position or the oxygen attached to the 3-position of the pyrazolidinone ring.

ADVANTAGEOUS EFFECT OF THE INVENTION

This invention allows for the design of films that provides neutral contrast in shortened development times, while still maintaining good curve shape in standard development cycles. The specific ballasted ETARCs used in the invention can be selectively coated in the appropriate record to provide contrast enhancement in whichever areas of the curve need it. Unlike the prior art, which involves the release of electron transfer agents in a non-imagewise manner when used with rapid processing, this invention provides the imagewise release of electron transfer agents. Such imagewise release provides benefits in imaging performance. The image-wise release from an ETARC enables a high concentration of ETA to be present where development is going on to amplify the signal. Also, in non-imagewise areas there is little or no release of ETA so that indiscriminate fog density is not amplified as it would be from the non-imagewise release disclosed in the prior art. Thus, imagewise release amplifies the desired signal more effectively and the undesirable noise less effectively than could be achieved from a non-imagewise release.

DETAILED DESCRIPTION OF THE INVENTION

The ETARCs utilized in the photographic elements processed by the method of the invention are represented by the formula $$CAR\text{-}(L)_n\text{-}ETA.$$

ETA is a 1-aryl-3-pyrazolidinone derivative having a calculated log partition coefficient (c log P) greater than 2.40 using MedChem v3.54. (Medicinal Chemistry Project, Pomona College, Claremont, Calif., 1987). Preferably the c log P is between and includes 2.40 and 3.50. On reaction with oxidized developing agent during processing, the CAR moiety releases the $-(L)_n$-ETA fragment. The ETA is released from $-(L)_n-$ and becomes an active electron transfer agent capable of accelerating development under processing conditions used to obtain the desired dye image.

The electron transfer agent pyrazolidinones that have been found to be useful in providing development increases are derived from compounds generally of the type described in U.S. Pat. Nos. 4,209,580; 4,463,081; 4,471,045; and 4,481,287 and in published Japanese Patent Application. No. 62-123172. Such compounds comprise a 3-pyrazolidinone structure having an unsubstituted or a substituted aryl group in the 1-position. Preferably these compounds have one or more alkyl groups in the 4- or 5-positions of the pyrazolidinone ring.

Preferred electron transfer agents suitable for use in this invention are represented by structural formulas I and II:

I

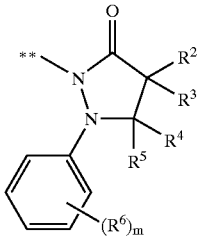

-continued

II

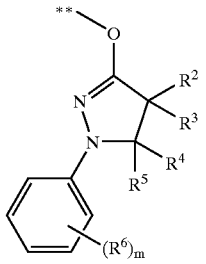

** denotes point of attachment to $CAR\text{-}(L)_n$——;

$R^2$ and $R^3$ each independently represents hydrogen, a substituted or unsubstituted alkyl group having from 1 to 12 carbon atoms, $CH_2OR^7$ or $CH_2OC(O)R^7$ where $R^7$ can be a substituted or unsubstituted alkyl, aryl, or a heteroatom containing group. When $R^2$ and $R^3$ are alkyl, $CH_2OR^7$ or $CH_2OC(O)R^7$ groups, and $R^7$ is a substituted or unsubstituted alkyl or aryl group, it is preferred that $R^2$ and $R^3$ comprise from 3 to 8 carbon atoms. When $R^7$ is a heteroatom containing group, it is preferred that $R^2$ and $R^3$ comprise from 4 to 12 carbon atoms. $R^7$ may contain, for example, a morpholino, imidazole, triazole or tetrazole group, or a sulfide or ether linkage.

$R^4$ and $R^5$ each independently represent hydrogen, a substituted or unsubstituted alkyl group having from 1 to 8 carbon atoms or a substituted or unsubstituted aryl group having from 6 to 10 carbon atoms. Preferably $R^4$ and $R^5$ each represent hydrogen.

$R^6$, which may be present in the ortho, meta or para positions of the aromatic ring, is any substituent which does not interfere with the required log partition coefficient or the functionality of the ETARC. In one embodiment $R^6$ independently represents hydrogen, halogen, a substituted or unsubstituted alkyl group having from 1 to 8 carbon atoms, a substituted or unsubstituted alkoxy group having from 1 to 8 carbon atoms, or an amido, sulfonamido, ester, cyano, sulfone, carbamoyl, uriedo group, or a heteroatom-containing group or ring. Preferably $R^6$ is hydrogen, halogen, a substituted or unsubstituted alkyl group having from 1 to 8 carbon atoms or a substituted or unsubstituted alkoxy group having from 1 to 8 carbon atoms. m is 0 to 5. When m is greater than 1, the $R^6$ substituents can be the same or different or can be taken together to form a carbocycle or heterocyclic ring; and Especially preferred releasable electron transfer agents, suitable for use in this invention, are presented in Table I with $R^4$ and $R^5$ being hydrogen:

TABLE I

| ETA No. | $R^2$ | $R^3$ | $R^6$ |
|---|---|---|---|
| 1 | $CH_3$ | $CH_2OC(O)iPr$ | H |
| 2 | $CH_3$ | $CH_2OC(O)tBu$ | H |
| 3 | $CH_3$ | $CH_2OC(O)Et$ | p-$CH_3$ |
| 4 | $CH_3$ | $CH_2OC(O)Et$ | 3,4-dimethyl |
| 5 | H | $CH_2OC_4H_9$-n | p-$OCH_3$ |
| 6 | $CH_3$ | $CH_2OC(O)CH_2$—O—$(CH_2)_2S(CH_2)_2SMe$ | H |

The amount of ETARC that can be employed with this invention can be any concentration that is effective for the intended purpose. A possible range for the compound to be employed is at a concentration from 6 $\mu$mole/m$^2$ to 500 $\mu$mole/m$^2$. A preferred concentration range is 20 $\mu$mole/m$^2$ to 140 $\mu$mole/m$^2$.

The ETA is attached to the coupler at a position that will cause the ETA to be inactive until released. The point of attachment of the ETA to the CAR or to the CAR-$(L)_n$-linking is through either the nitrogen atom in the 2-position or the oxygen attached to the 3-position of the pyrazolidinone ring as shown for structures I or II. Such attachment inactivates the ETA so that it is unlikely to cause undesirable reactions during storage of the photographic material. However, the oxidized developer formed in an imagewise manner as a consequence of silver halide development reacts with the CAR moiety to lead to the cleavage of the bond between the CAR and L. L undergoes further reaction to release the active ETA moiety.

The linking group -$(L)_n$- is employed to provide for controlled release of the ETA moiety from the coupler moiety so that the effect of accelerated silver halide development can be quickly attained. L represents a divalent linking group which is both a good leaving group and allows release of the ETA without a long delay. n is 0, 1 or 2. In one embodiment L is not —O—CO—. Various types of known linking groups can be used. These include quinone methide linking groups such as are disclosed in U.S. Pat. No. 4,409,323; pyrazolonemethide linking groups such as are disclosed in U.S. Pat. No. 4,421,845; and intramolecular nucleophillic displacement type linking groups such as are disclosed in U.S. Pat. No. 4,248,962. Examples of CAR-L-ETA include

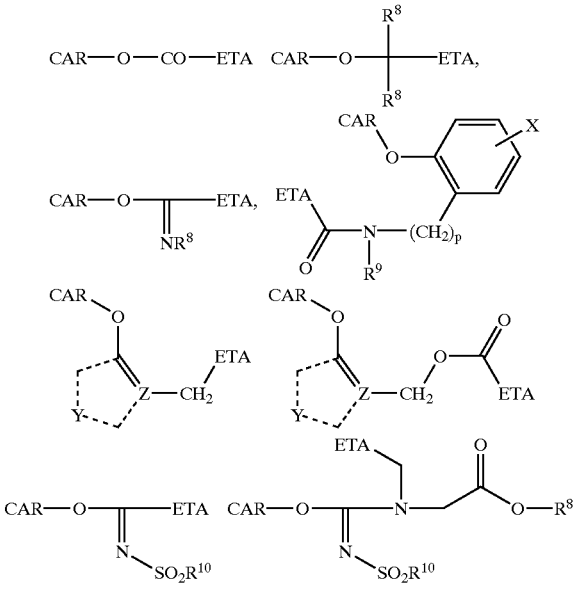

wherein each $R^8$ can independently be hydrogen, a substituted or unsubstituted alkyl group of 1 to 12 carbon atoms or a substituted or unsubstituted aryl group of 6 to 10 carbon atoms. More preferably $R^8$ is a substituted or unsubstituted alkyl group of 1 to 4 carbon atoms. $R^9$ is a substituted or unsubstituted alkyl group of from 1 to 20 carbon atoms, preferably of from 1 to 4 carbon atoms, or a substituted or unsubstituted aryl group of from 6 to 20 carbon atoms, preferably of from 6 to 10 carbon atoms. X is an —$NO_2$, —CN, sulfone, sulfonamide, halogen or alkoxycarbonyl group, and p is 0 or 1.

Y represents the atoms necessary to form is a substituted or unsubstituted carbocyclic aromatic ring, or a substituted or unsubstituted heterocyclic aromatic ring. Preferably Y forms a carbocyclic aromatic ring having 6 to 10 carbon atoms or a 5-membered heterocyclic aromatic ring. Suitable heterocyclic rings include pyrazoles, imidazoles, triazoles, pyrazolotriazoles, etc. $R^{10}$ is a substituted or unsubstituted alkyl or aryl group. Z is a carbon or nitrogen atom.

Particularly suitable linking groups are contained within the formulas representing CAR-L-ETA below:

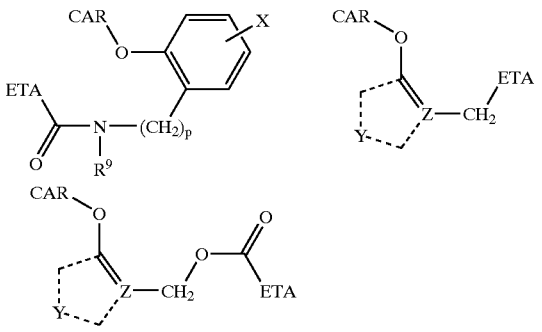

wherein Y represents the atoms necessary to form a substituted or unsubstituted phenyl ring, Z is a carbon atom, and $R^9$ and p are as defined above. Typical useful linking groups include:

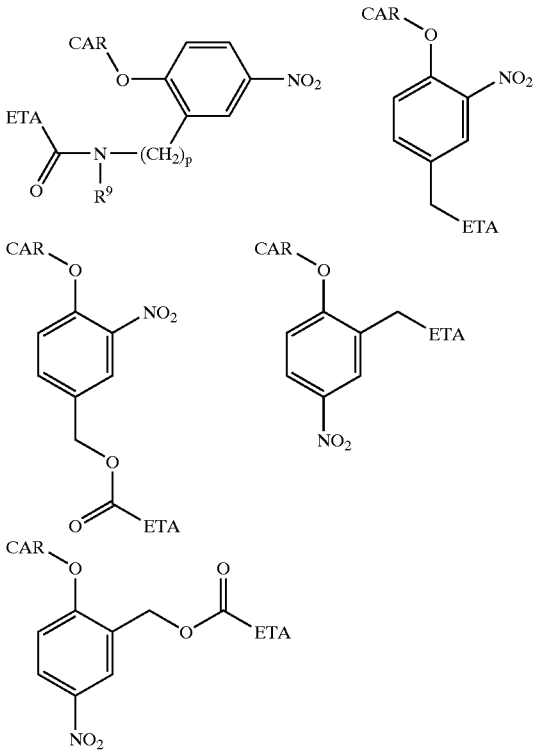

where $R^9$ is as defined above and p is 0 or 1.

CAR is a carrier moiety that is capable of releasing -$(L)_n$-ETA on reaction with oxidized developing agent. In a preferred embodiment, CAR is a coupler moiety that can release -$(L)_n$-ETA from the coupling site during reaction with oxidized primary amine color developing agent. CAR carriers that are triggered by reaction with oxidized developing agent are capable of releasing a photographically useful group (PUG) and are particularly well known in development inhibitor release (DIR) technology where the PUG is a development inhibitor. Typical references to hydroquinone type carriers are U.S. Pat. Nos. 3,379,529; 3,297,445; and 3,975,395. U.S. Pat. No. 4,108,663 discloses similar release from aminophenol and aminonaphthol carriers, while U.S. Pat. No. 4,684,604 features PUG-releasing hydrazide carriers. All of these may be classified as redox-activated carriers for PUG release.

A far greater body of knowledge has been built up over the years on carriers in which a coupler releases a PUG upon condensation with an oxidized primary amine color developing agent. These can be classified as coupling-activated carriers. Representative are U.S. Pat. Nos. 3,148,062; 3,227,554; 3,617,291; 3,265,506; 3,632,345; and 3,660,095.

The coupler, from which the electron transfer agent pyrazolidinine moiety is released, includes couplers employed in conventional color-forming photographic processes that yield colored products based on reactions of couplers with oxidized color developing agents. The couplers can also yield colorless products on reaction with oxidized color developing agents. The couplers can also form dyes that are unstable and which decompose into colorless products. Further, the couplers can provide dyes that wash out of the photographic recording materials during processing. Such couplers are well known to those skilled in the art.

The coupler can be unballasted or ballasted with an oil-soluble or fat-tail group. It can be monomeric, or it can form part of a dimeric, oligomeric, or polymeric coupler in which case more than one ETA moiety or $-(L)_n$-ETA moiety can be contained in the ETA releasing compound.

Many coupler kinds are known. The dyes formed therefrom generally have their main absorption in the red, green, or blue regions of the visible spectrum. For example, couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; and 4,333,999; and "Farbkuppler: Eine Literaturubersicht," published in Agfa Mitteilungen, Band III, pp. 156–175 (1961). In the coupler structures shown below, the unsatisfied bond indicates the coupling position to which $-(L)_n$-ETA may be attached.

Preferably such couplers are phenols and naphthols that give cyan dyes on reaction with oxidized color developing agent at the coupling position, i.e., the carbon atom in the 4-position of the phenol or naphthol. Structures of such preferred cyan couplers are:

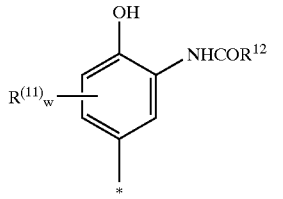

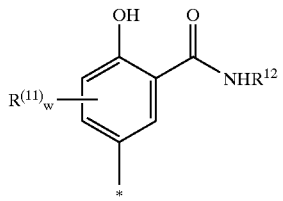

-continued

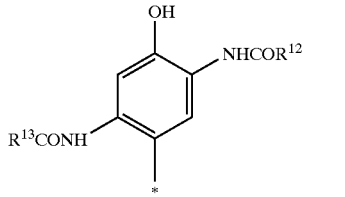

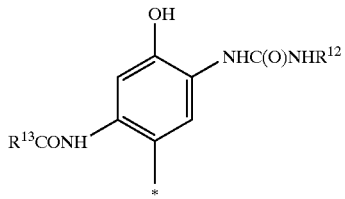

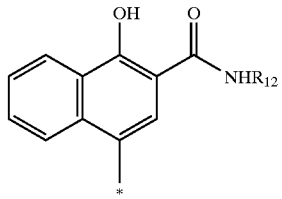

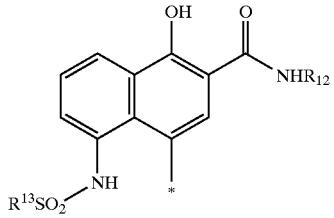

* denotes link to —$(L)_n$—ETA where $R^{12}$ and $R^{13}$ are a ballast group, a hydrogen, or a substituted or unsubstituted alkyl or aryl group, $R^{11}$ is a halogen atom, an alkyl group having from 1 to 4 carbon atoms or an alkoxy group having from 1 to 4 carbon atoms, and w is 1 or 2. Generally $R^{12}$ and $R^{13}$ are groups having less than 20 carbon atoms.

Couplers that form magenta dyes upon reaction with oxidized developing agent are described in such representative patents and publications as: U.S. Pat. Nos. 2,600,788; 2,369,489; 2,343,703; 2,311,082; 3,824,250; 3,615,502; 4,076,533; 3,152,896; 3,519,429; 3,062,653; 2,908,573; 4,540,654; and "Farbkuppler: Eine Literaturubersicht," published in Agfa Mitteilungen, Band III, pp. 126–156 (1961).

Preferably, such couplers are pyrazolones and pyrazolotriazoles that form magenta dyes upon reaction with oxidized developing agents at the coupling position, i.e., the carbon atom in the 4-position for pyrazolones and the 7-position for pyrazolotriazoles. Structures of such preferred magenta coupler moieties are:

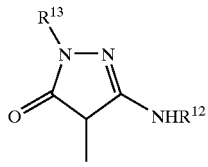

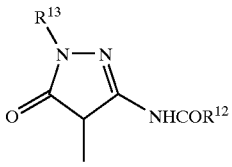

-continued

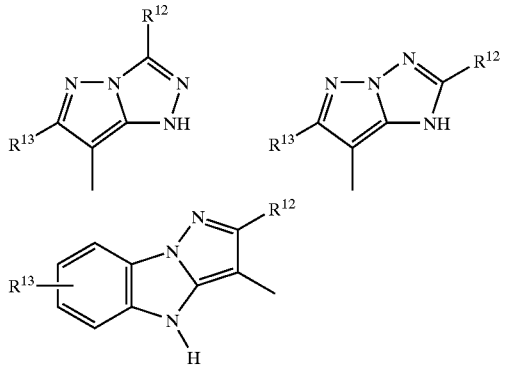

wherein $R^{12}$ and $R^{13}$ are defined above. $R^{13}$ for pyrazolone structures is typically a phenyl group or a substituted or unsubstituted phenyl group, such as, for example, 2,4,6-trihalophenyl. For the pyrazolotrazole structures $R^{13}$ is typically alkyl or aryl.

Couplers that form yellow dyes on reaction with oxidized color developing agent are described in such representative patents and publications as U.S. Pat. Nos. 2,875,057; 2,407,210; 3,265,506; 2,298,443; 3,048,194; and 3,447,928; and "Farbkuppler: Eine Literaturubersicht," published in Agfa Mitteilungen, Band III, pp. 112–126 (1961.

Preferably, such yellow dye-forming couplers are acylacetamides, such as benzoylacetanilides and pivalylacetanilides. These couplers react with oxidized developing agent at the coupling position, i.e., the active methylene carbon atom. Structures of such preferred yellow couplers are:

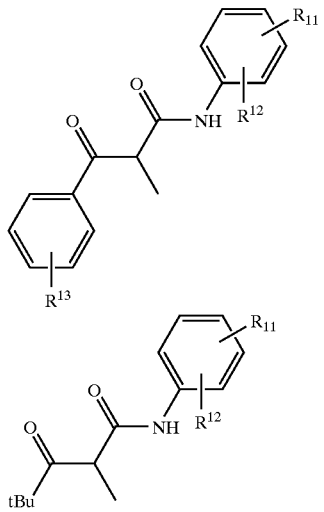

where $R^{12}$ and $R^{13}$ are defined above and can also be alkoxy, alkoxycarbonyl, alkanesulfonyl, arenesulfonyl, aryloxycarbonyl, carbonamido, carbamoyl, sulfonamido, or sulfamoyl. $R^{11}$ is hydrogen or one or more halogen, lower alkyl, (i.e., methyl, ethyl), lower alkoxy (i.e., methoxy, ethoxy), or a ballast (i.e., alkoxy of 16 to 20 carbon atoms) group.

Couplers that form colorless products upon reaction with oxidized color developing agent are described in such representative patents as: U.K. Patent No. 861,138 and U.S. Pat. Nos. 3,632,345; 3,928,041; 3,958,993; and 3,961,959. Preferably, such couplers are cyclic carbonyl containing compounds that form colorless products on reaction with oxidized color developing agent and have the L group attached to the carbon atom in the α-position with respect to the carbonyl group. Structures of such preferred couplers are:

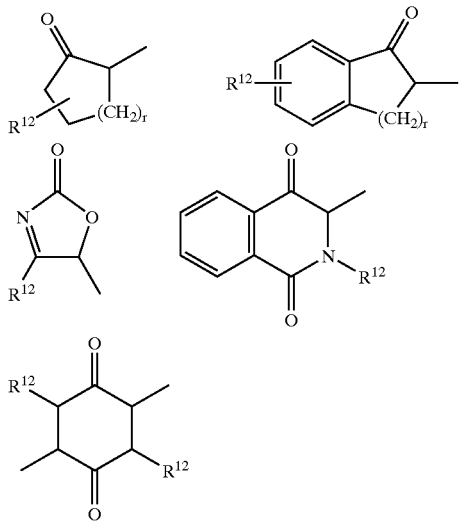

where $R^{12}$ is defined as above, and r is 1 or 2.

It will be appreciated, depending on the particular coupler moiety, or the particular developing agent, or the type of processing, the reaction product of the coupler and oxidized color developing agent can be: (1) colored and non-diffusible, in which case it may not be removed during processing from the location where it is formed; (2) colored and diffusible, in which case it may be removed during processing from the location where it is formed or allowed to migrate to a different location; or (3) colorless and diffusible or non-diffusible, in which case it will not contribute to image density.

Especially preferred structures for CAR-$(L)_n$-ETA are compounds E-1 through E-12, E-15, and E-17. Compounds C-1, C-2, and C-3 are comparative compounds.

E-1

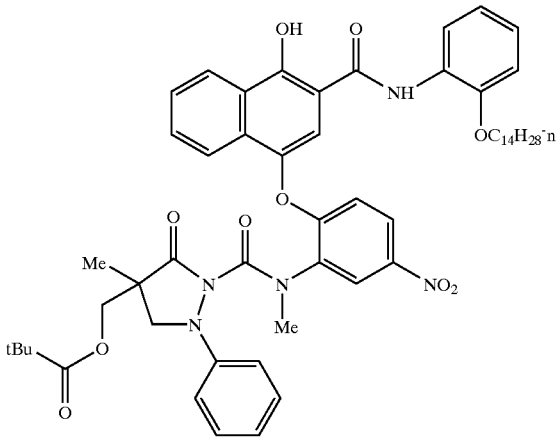

-continued
E-2
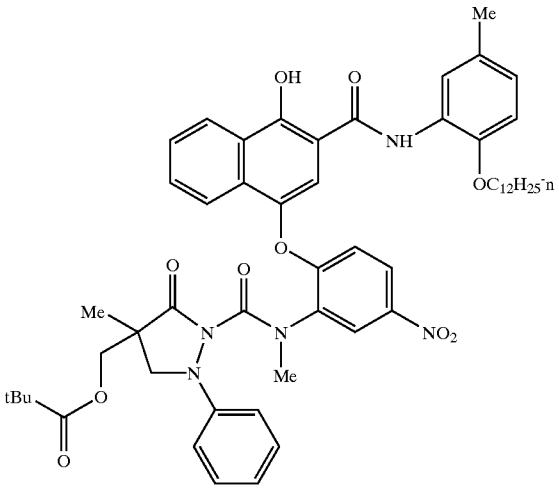
E-3
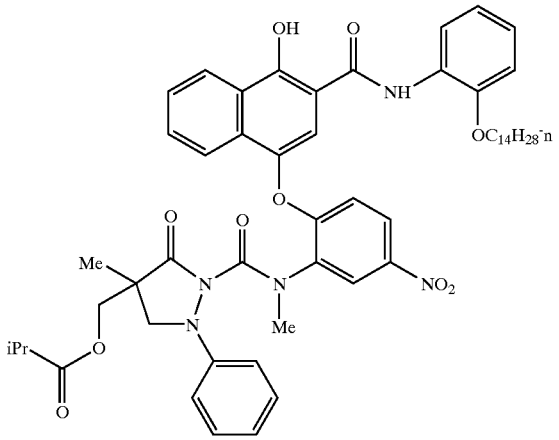
E-4
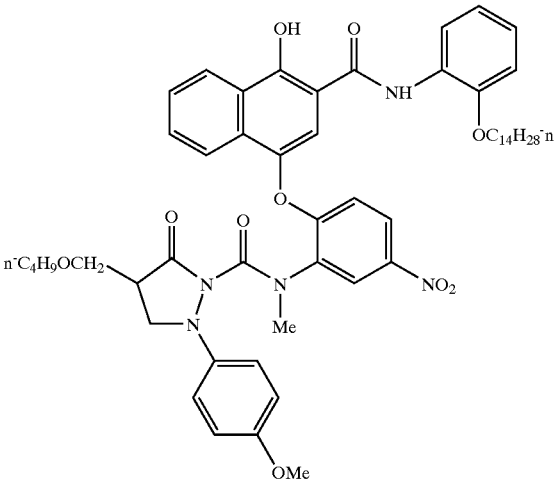
-continued
E-5
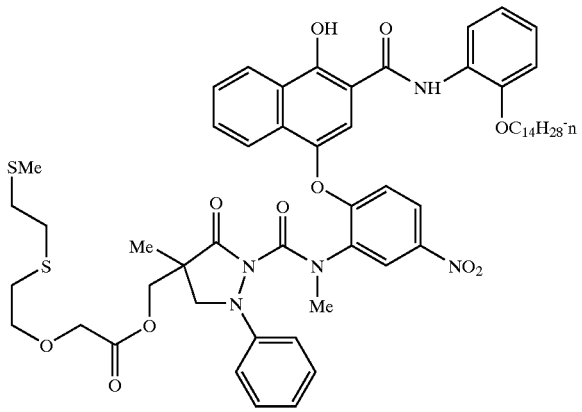
E-6
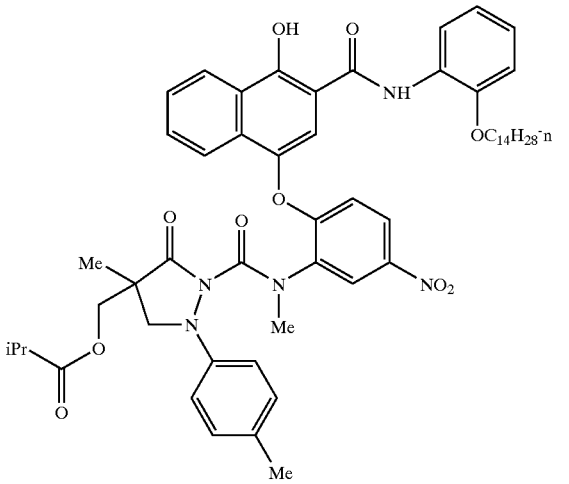
E-7
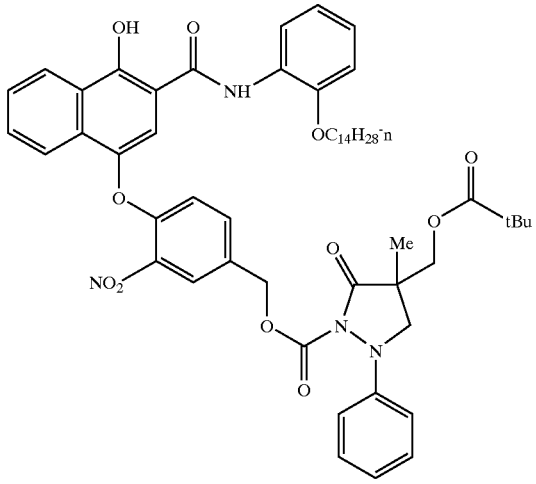

-continued
E-9
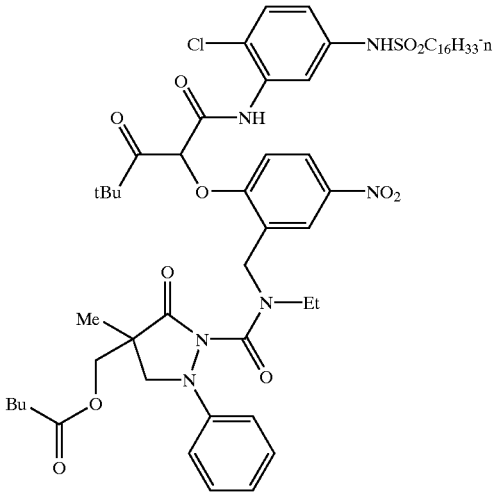
E-10
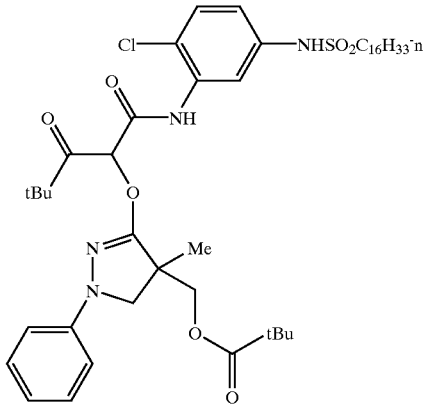
E-11
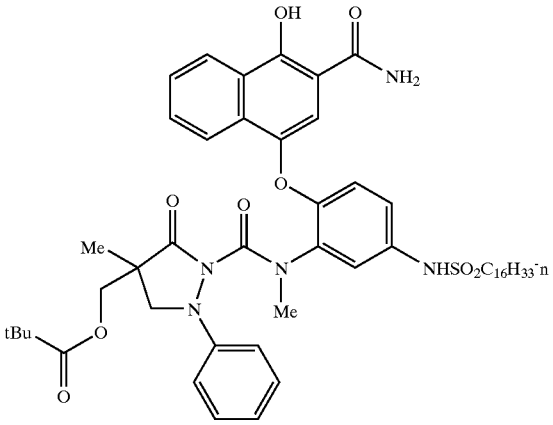
-continued
E-12
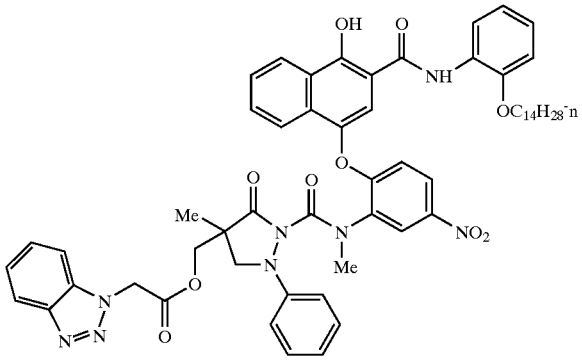
E-15
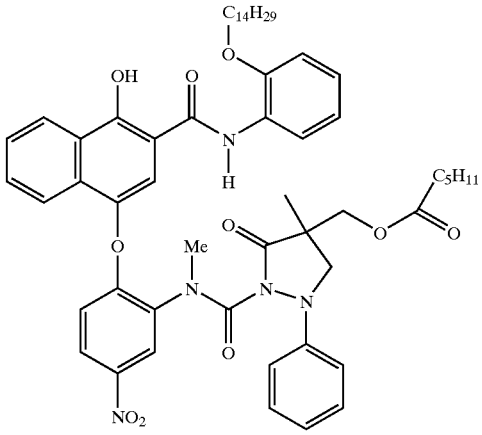
E-17
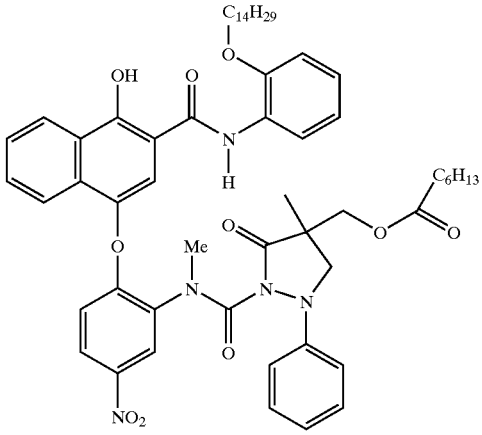

-continued

C-1

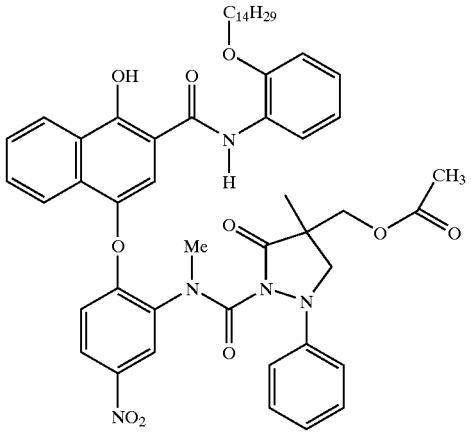

C-2

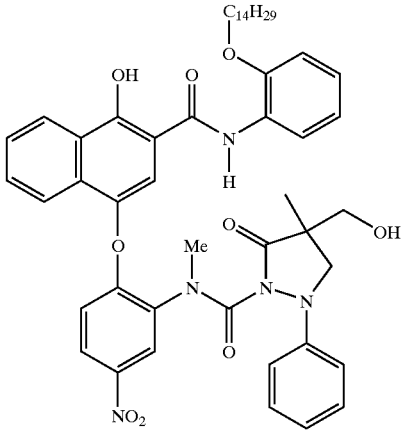

C-3

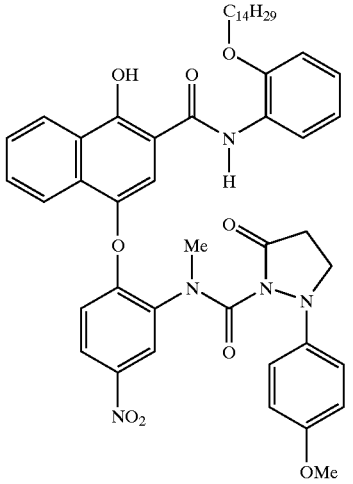

Electron transfer agent releasing coupler compounds used in this invention can be prepared by several synthetic routes. Many of the preferred ETAs of this patent are esters of 4-(hydroxymethyl)-4-methyl-1-phenyl-3-pyrazolidinone. Selective formation of esters at the 4-hydroxymethyl group of 4-(hydroxymethyl)-4-methyl-1-phenyl-3-pyrazolidinone has been reported in U.K. Patent 2,073,734 and can be accomplished by treating 4-(hydroxymethyl)-4-methyl-1-phenyl-3-pyrazolidinone with an acid chloride in refluxing toluene. The resulting ETA can be converted, by treatment with phosgene, to the corresponding carbamoyl chloride that is then caused to react with an amino group or linking group attached to a coupler. Examples of the synthesis of these compounds can be found in U.S. Pat. Nos. 6,110,657 of Lunt et al; 6,114,103 of Friday et al; and EP 1 111 458 A1 (published Jun. 27, 2001) which are incorporated herein by reference.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylaamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl, quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The photographic elements utilized in the invention contain more than one image dye-forming unit. Generally the photographic elements contain image dye-forming units sensitive to each of the three primary regions of the spectrum. Each unit can comprise a single emulsion layer or multiple emulsion layers sensitive to a given region of the spectrum. It is preferred that each unit contain multiple emulsion layers. The layers of the element, including the layers of the image-forming units, can be arranged in various orders as known in the art. The ETARC utilized in the invention is contained in the dye image unit closest to the support. It is preferred that the ETARC utilized in the invention is contained in the least light sensitive layer of the color unit closest to the support.

In one suitable embodiment, the photographic element of this invention comprises a support bearing, in order from the support, a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The ETARC is contained in the red-sensitive layer. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, N.H. PO10 7DQ, ENGLAND, the contents of which are incorporated herein by reference. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, N.H. PO10 7DQ, ENGLAND, and such as the Advanced Photo System, particularly the Kodak ADVANTIX films or cameras.

In the following Table, reference will be made to (1) *Research Disclosure*, December 1978, Item 17643; (2) *Research Disclosure*, December 1989, Item 308119; (3) *Research Disclosure*, September 1994, Item 36544; and (4) *Research Disclosure*, September 1996, Item 38957, all published by Kenneth Mason Publications, Ltd., Dudley Annex, 12a North Street, Emsworth, N.H. PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038 and in *Research Disclosure*, September 1997, Item 40145 published by Kenneth Mason Publications, Ltd., Dudley Annex, 12a North Street, Emsworth, N.H. PO10 7DQ, ENGLAND, the disclosure of which is incorporated herein by reference.

| Reference | Section | Subject Matter |
|---|---|---|
| 1 | I, II | Grain composition, morphology and |
| 2 | I, II, IX, X, XI, XII, XIV, XV | preparation. Emulsion preparation including hardeners, coating aids, |
| 3 & 4 | I, II, III, IX A & B | addenda, etc. |
| 1 | III, IV | Chemical sensitization and spectral |
| 2 | III, IV | sensitization/Desensitization |
| 3 & 4 | IV, V | |
| 1 | V | UV dyes, optical brighteners, |
| 2 | V | luminescent dyes |
| 3 & 4 | VI | |
| 1 | VI | Antifoggants and stabilizers |
| 2 | VI | |
| 3 & 4 | VII | |
| 1 | VIII | Absorbing and scattering materials; |
| 2 | VIII, XIII, XVI | Antistatic layers; matting agents |
| 3 & 4 | VIII, IX C & D | |
| 1 | VII | Image-couplers and image- |
| 2 | VII | modifying couplers; Wash-out |
| 3 & 4 | X | couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |

-continued

| Reference | Section | Subject Matter |
|---|---|---|
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

Image dye forming couplers are present in the photographic elements. The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, heteroxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in UK. Patents and published application Nos. 1,466,728; 1,531,927; 1,533,039; 2,006,755 A; and 2,017,704 A, the disclosures of which are incorporated herein by reference.

Other image dye-forming couplers may be included in the element such as those image couplers already described above for CAR. In one preferred embodiment a dye forming coupler is contained in the same emulsion layer as the ETARC utilized in this invention. Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628; 5,151,343; and 5,234,800.

It may be useful to use a combination of couplers any of which may contain known ballasts or coupling-off groups such as those described in U.S. Pat. Nos. 4,301,235; 4,853,319; and 4,351,897. The coupler may contain solubilizing groups such as described in U.S. Pat. No. 4,482,629. The coupler may also be used in association with "wrong" colored couplers (e.g., to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The photographic elements may contain materials that accelerate or otherwise modify the processing steps, e.g., of bleaching or fixing to improve the quality of the image. Bleach accelerator releasing couplers such as those described in EP 193,389; EP 301,477; U.S. Pat. Nos. 4,163,669; 4,865,956; and U.S. Pat. No. 4,923,784 may be useful. Also contemplated is use of the compositions in association with nucleating agents, development accelerators or their precursors (UK Patents 2,097,140 and 2,131,188); other electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. Nos. 4,366,237; 4,420,556; and 4,543,323; and EP 096 570). Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). In one suitable embodiment a DIR compound is contained in the dye imaging unit closest to the support. It may be contained in any emulsion layer in the dye imaging unit; however, it is preferably contained in the same layer as the ETARC utilized in the invention. DIR's useful in conjunction with the compositions of the invention are known in the art, and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563, 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416, as well as the following European Patent Publications: 272,573; 335,319; 336,411; 346,899; 362,870; 365,252; 365,346; 373,382; 376,212; 377,463; 378,236; 384,670; 396,486; 401,612; and 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles.

In a preferred embodiment, the inhibitor moiety or group is selected from the following formulas:

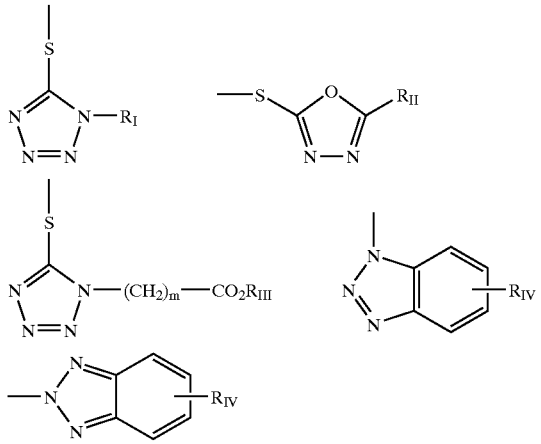

wherein $R_I$ is selected from the group consisting of straight- and branched-alkyls of from 1 to about 8 carbon atoms, benzyl, phenyl, and alkoxy groups and such groups containing none, one, or more than one such substituent; $R_{II}$ is selected from $R_I$ and —$SR_I$; $R_{III}$ is a straight- or branched-alkyl group of from 1 to about 5 carbon atoms, and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323 and 4,421,845; Japanese Applications 57-188035; 58-98728; 58-209736; and 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. Nos. 4,438,193 and 4,618,571) and groups that combine the features describe above. It is typical that the timing group or moiety is of one of the formulas:

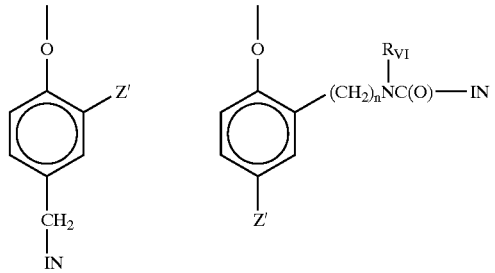

wherein IN is the inhibitor moiety, Z' is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

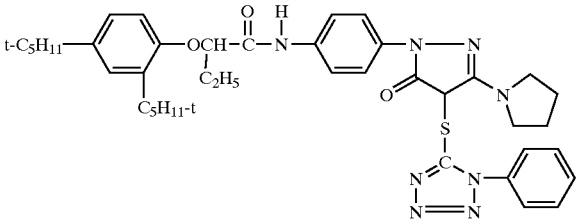

D2

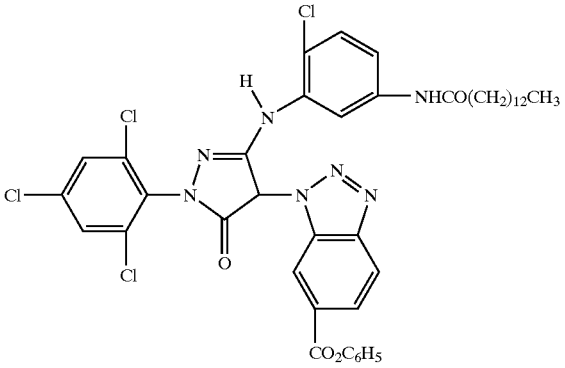

D3

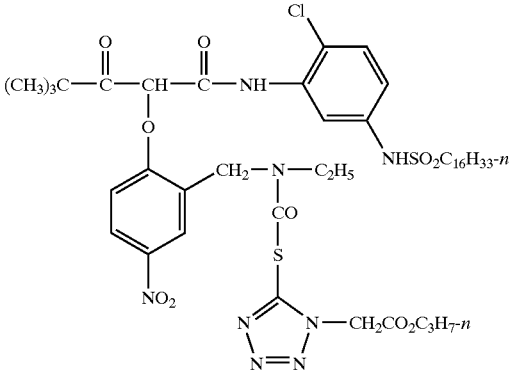

-continued

D4

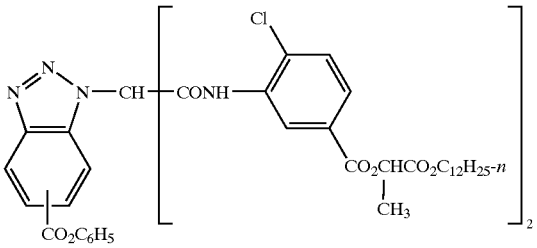

D5

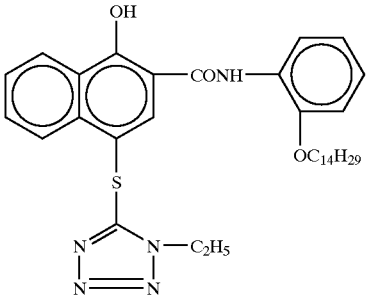

D6

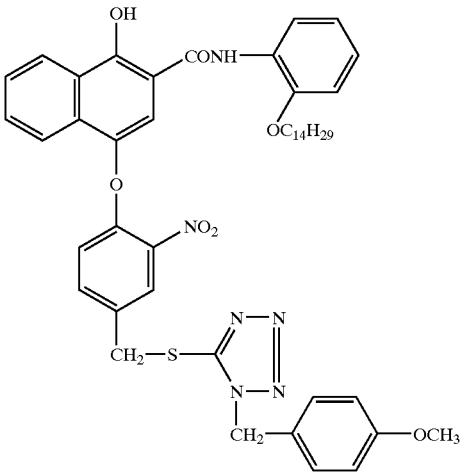

D7

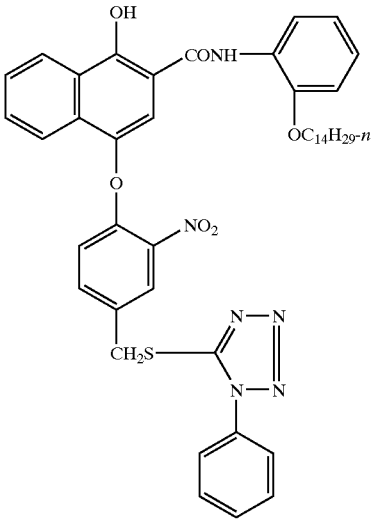

-continued

D8

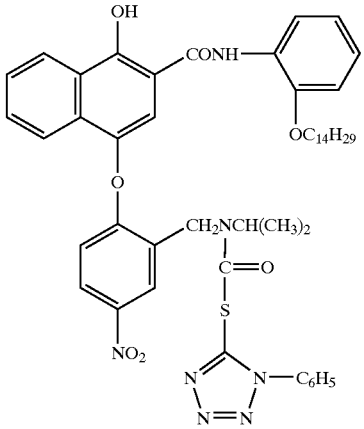

D9

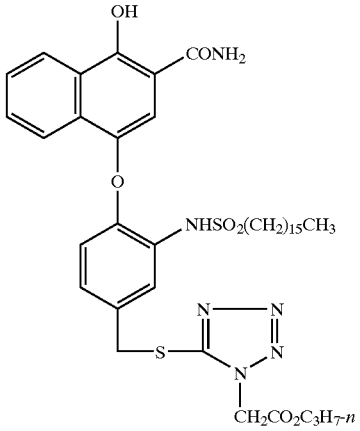

D10

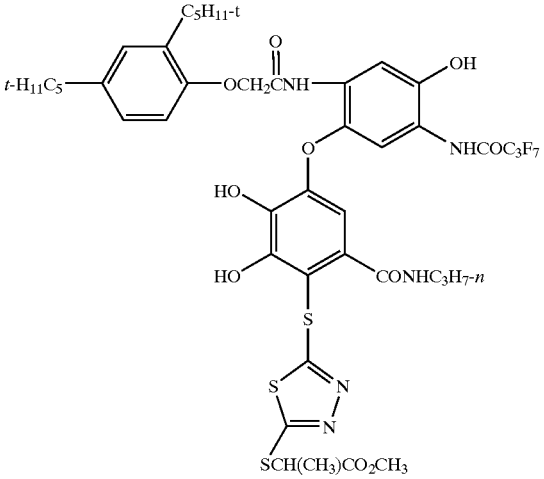

The silver halide emulsions utilized in this invention are bromoiodide emulsions. Generally, the iodide content of such silver bromoiodide emulsions is less than about 40 mol % (based on total silver), preferably from about 0.05 to about 10 mol %, and more preferably from about 0. 5 to about 6 mol %. The emulsions can be of any crystal morphology (such as cubic, octahedral, cubooctahedral, or tabular as are known in the art), or irregular morphology (such as multiple twinning or rounded). Especially useful in this invention are tabular grain silver halide emulsions.

Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520; Wilgus et al U.S. Pat. No. 4,434,226; Solberg et al U.S. Pat. No. 4,433,048; Maskasky U.S. Pat. Nos. 4,435,501; 4,463,087; and 4,173,320; Daubendiek et al U.S. Pat. Nos. 4,414,310 and 4,914,014, Sowinski et al U.S. Pat. No. 4,656,122; Piggin et al U.S. Pat. Nos. 5,061,616 and 5,061,609, Tsaur et al U.S. Pat. Nos. 5,147,771; '772; '773; 5,171,659; and 5,252,453; Black et al U.S. Pat. Nos. 5,219,720 and 5,334,495; Delton U.S. Pat. Nos. 5,310,644; 5,372,927; and 5,460,934; Wen U.S. Pat. No. 5,470,698; Fenton et al U.S. Pat. No. 5,476,760; Eshelman et al U.S. Pat. Nos. 5,612,175 and 5,614,359; and Irving et al U.S. Pat. No. 5,667,954.

Ultrathin high bromide {111} tabular grain emulsions are illustrated by Daubendiek et al U.S. Pat. Nos. 4,672,027, 4,693,964; 5,494,789; 5,503,971; and 5,576,168; Antoniades et al U.S. Pat. No. 5,250,403; Olm et al U.S. Pat. No. 5,503,970; Deaton et al U.S. Pat. No. 5,582,965; and Maskasky U.S. Pat. No. 5,667,955. High bromide {100} tabular grain emulsions are illustrated by Mignot U.S. Pat. Nos. 4,386,156 and 5,386,156.

Such color silver bromoiodide elements generally have a camera speed defined as an ISO speed of at least 25, preferably an ISO speed of at least 50, and more preferably an ISO speed of at least 100. The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27—1979 (ASA speed) and relates to the exposure levels required to enable a density of 0.15 above fog in the green light sensitive and least sensitive recording unit of a multicolor negative film. This definition conforms to the International Standards Organization (ISO) film speed rating.

The photographic elements are preferably exposed to actinic radiation, typically in the visible region of the spectrum, to form a latent image, and then processed to form a visible dye image. Development is typically followed by the conventional steps of bleaching, fixing, or bleach-fixing, to remove silver or silver halide, washing, and drying.

In the method of the invention the photographic element is contacted with the color developer for less than 120 seconds, with a time of from about 20 to about 120 seconds being preferred. More preferably, the photographic element is contacted with the color developer for 100 seconds or less, and most preferably for 60 seconds or less. The overall processing time (from development to final rinse or wash) can be from about 40 seconds to about 40 minutes. Shorter overall processing times, that is, less than about 3 minutes, are desired for processing photographic color negative films according to this invention. For rapid color development, the processing temperature is generally from about 40 to about 65° C., preferably from about 45 to about 65° C., and more preferably from about 50 to about 60° C. Most preferably, the development temperature is from about 55 to about 60° C.

The length of time and temperatures used for each processing step of the present invention, other than color development, can be any desired condition, whether conventional or not.

The color developing compositions used in this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097 A1 (published Jun. 26, 1991) and EP 0 530 921 A1 (published Mar. 10, 1993). It may be useful for the color developing agents to have one or more water-solubilizing groups as are known in the art. Further details of such materials are provided in *Research Disclosure*, publication 38957, pages 592–639 (September 1996).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-2'-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. Particularly suitable for use in the current invention is 4-(N-ethyl-N-2'-hydroxyethylamino)-2-methylaniline sulfate (KODAK Color Developing Agent CD-4).

In order to protect the color developing agents from oxidation, one or more antioxidants are generally included in the color developing compositions. In the developer compositions used in the invention both a sulfite compound (such as sodium sulfite, potassium sulfite, sodium bisulfite, and potassium metabisulfite) and an additional antioxidant are utilized. Either inorganic or organic antioxidants can be used as the additional antioxidant. Many classes of useful antioxidants are known, including but not limited to, hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclobexadiones as described in U.S. Pat. No. 6,077,653. Mixtures of compounds from the same or different classes of antioxidants can also be used if desired.

The most preferred antioxidant for use in this invention is hydroxylamine sulfate. Other useful antioxidants are hydroxylamine derivatives as described, for example, in U.S. Pat. No. 4,892,804 (Vincent et al), U.S. Pat. No. 4,876,174 (Ishikawa et al), U.S. Pat. No. 5,354,646 (Kobayashi et al), U.S. Pat. No. 5,660,974 (Marrese et al), and U.S. Pat. No. 5,646,327 (Burns et al), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy, and other solubilizing substituents.

The noted hydroxylamine derivatives can be mono- or dialkylhydroxylamines having one or more hydroxy substituents on the one or more alkyl groups. Representative compounds of this type are described, for example, in U.S. Pat. No. 5,709,982 (Marrese et al), incorporated herein by reference, as having the following Structure I:

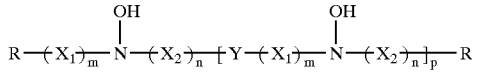

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_3$— and $X_2$ is —$CHR_1CR_2(OH)$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n and p are independently 0 or 1. Preferably, each of m and n is 1, and p is 0.

Specific di-substituted hydroxylamine antioxidants include, but are not limited to, N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Also useful are the antioxidants disclosed in U.S. Pat. No. 5,827,635 represented by the formula:

R"-L-N(OH)-L'-R' wherein L and L' are independently substituted or unsubstituted alkylene of 1 to 8 carbon atoms (such as methylene, ethylene, n-propylene, isopropylene, n-butylene, 1,1-dimethylethylene, n-hexylene, n-octylene and sec-butylene), or substituted or unsubstituted alkylenephenylene of 1 to 3 carbon atoms in the alkylene portion (such as benzylene, dimethylenephenylene, and isopropylenephenylene).

The alkylene and alkylenephenylene groups can also be substituted with up to 4 substituents that do not interfere with the stabilizing effect of the molecule, or the solubility of the compound in the color developer solution. Such substituents must be compatible with the color developer components and must not negatively impact the photographic processing system. Such substituents include, but are not limited to, alkyl of 1 to 6 carbon atoms, fluoroalkyl groups of 1 to 6 carbon atoms, alkoxy of 1 to 6 carbon atoms, phenyl, hydroxy, halo, phenoxy, alkylthio of 1 to 6 carbon atoms, acyl groups, cyano, or amino.

In the noted formula, R" and R' are independently hydrogen, carboxy, sulfo, phosphono, or other acid groups, provided that at least one of R" and R' is not hydrogen. Salts of the acid groups are considered equivalents in this invention. Thus, the free acid forms of the hydroxylamines can be used, as well as the organic or inorganic salts of the acids, such as the alkali metal, pyridinium, tetraethylammonium, tetramethylammonium and ammonium salts. The sodium and potassium salts are the preferred salts. In addition, readily hydrolyzable ester equivalents can also be used, such as the methyl and ethyl esters of the acids. When L or L' is alkylenephenylene, the carboxy, sulfo or phosphono group is preferably at the para position of the phenylene, but can be at other positions if desired. More than one carboxy, sulfo, or phosphono group can be attached to the phenylene radical.

Preferably, one or both of R" and R' are hydrogen, carboxy or sulfo, with hydrogen and sulfo (or salts or readily hydrolyzable esters thereof) being more preferred. Most preferably, R is hydrogen and R' is sulfo (or a salt thereof).

Preferably, L and L' are independently substituted or unsubstituted alkylene of 3 to 6 carbon atoms (such as n-propyl, isopropyl, n-butyl, sec-butyl, t-butyl, n-pentyl, 1-methylpentyl and 2-ethylbutyl), or substituted or unsubstituted alkylenephenylene having 1 or 2 carbon atoms in the alkylene portion (such as benzyl and dimethylenephenyl).

More preferably, at least one, and optionally both, of L and L' is a substituted or unsubstituted alkylene group of 3 to 6 carbon atoms that is branched at the carbon atom directly attached (that is, covalently bonded) to the nitrogen atom of the hydroxylamine molecule. Such branched divalent groups include, but are not limited to, isopropylene, sec-butylene, t-butylene, sec-pentylene, t-pentylene, sec-hexylene and t-hexylene. Isopropylene is most preferred.

In one embodiment, L and L' are the same. In other and preferred embodiments, they are different. In the latter embodiment, L is more preferably a branched alkylene as described above, and L' is a linear alkylene of 1 to 6 carbon atoms (such as methylene, ethylene, n-propylene, n-butylene, n-pentylene and n-hexylene).

Representative hydroxylamine derivatives useful in the practice of this invention include, but are not limited to, N-isopropyl-N-(2-ethanesulfonic acid)hydroxylamine, N,N-bis(propionic acid)hydroxylamine, N,N-bis(2-ethanesulfonic acid)hydroxylamine, N-isopropyl-N-(n-propylsulfonic acid)hydroxylamine, N-2-ethanephosphonic acid-N-(propionic acid)hydroxylaamine, N,N-bis(2-ethanephosphonic acid)hydroxylamine, N-sec-butyl-N-(2-ethanesulfonic acid)hydroxylamine, N,N-bis(sec-butylcarboxylic acid)hydroxylamine, N-methyl-N-(p-carboxylbenzyl)hydroxylamine, N-isopropyl-N-(p-carboxylbenzyl)hydroxylamine, N,N-bis(p-carboxylbenzyl) hydroxylamine, N-methyl-N-(p-carboxyl-m-methylbenzyl) hydroxylamine, N-isopropyl-N-(p-sulfobenzyl) hydroxylamine, N-ethyl-N-(p-phosphonobenzyl) hydroxylamine, N-isopropyl-N-(2-carboxymethylene-3-propionic acid)hydroxylamine, and alkali metal salts thereof.

Many of the noted antioxidants (organic or inorganic) are either commercially available or prepared using starting materials and procedures described in the references noted above in describing hydroxylamines.

Buffering agents are generally present in the color developing compositions used in this invention to provide or maintain the desired alkaline pH of from about 9 to about 12, and more preferably from about 9 to about 11. These buffering agents must be soluble in the organic solvent described herein and have a pKa of from about 9 to about 13.

Such useful buffering agents include, but are not limited to, carbonates, borates, tetraborates, glycine salts, triethanolamine, diethanolamine, phosphates, and hydroxybenzoates. Alkali metal carbonates (such as sodium carbonate, sodium bicarbonate, and potassium carbonate) are preferred buffering agents. Mixtures of buffering agents can be used if desired.

In addition to buffering agents, pH can also be raised or lowered to a desired value using one or more acids or bases. It may be particularly desirable to raise the pH by adding a base, such as a hydroxide (for example, sodium hydroxide or potassium hydroxide).

An optional but preferred component of the color developing compositions used in this invention is a photographically inactive, water-miscible or water-soluble, straight-chain organic solvent, that is, capable of dissolving color developing agents in their free base forms. Such organic solvents can be used singly or in combination, and preferably each has a molecular weight of at least 50, and preferably at least 100, and generally 200 or less, and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

By "photographically inactive" is meant that the organic solvents provide no substantial positive or negative effect upon the color developing function of the concentrate.

Useful organic solvents include, but are not limited to, polyols including glycols (such as ethylene glycol, diethylene glycol and triethylene glycol), polyhydroxyamines (including polyalcoholamines), and alcohols (such as ethanol and benzyl alcohol). Glycols are preferred with ethylene glycol, diethylene glycol and triethylene glycol being most preferred. Of the alcohols, ethanol and benzyl alcohol are most preferred. The most preferred organic solvent is diethylene glycol.

The solution can also include one or more of a variety of other addenda which are commonly used in such compositions, such as alkali metal halides (such as potassium chloride, potassium bromide, sodium bromide, and sodium iodide), metal sequestering agents (such as polycarboxylic or aminopolycarboxylic acids or polyphosphonates), buffers (as noted above), other preservatives (such as sulfites and alcoholamines), antifoggants, development accelerators, optical brighteners, wetting agents, stain reducing agents, surfactants, defoaming agents, and water-soluble or water-dispersible color couplers, as would be readily understood by one skilled in the art (see, for example, *Research Disclosure*, noted above and U.S. Pat. No. 4,814,260 of Koboshi et al). The amounts of such additives are well known in the art also. For example, the amounts of halides can be varied widely, but are generally at least about $5\times10^{-5}$ to about 0.4 mol/l for bromide ion and at least about $5\times10^{-7}$ and up to about 0.01 mol/l for iodide ion. The color developing solution may or may not contain chloride ion because chloride ion essentially has no effect on the efficacy of the color developer composition. Thus, generally, chloride ion is not added or present, but if it is, it is not detrimental to the invention. It is more important that some bromide and iodide ions be present in the color developer solution. Other anions besides bromide or iodide may also be utilized, for example, thiocyanate, that is used in the black-and-white developer for Ektachrome E-6 processing. The ability to put more Ag+ into solution is also advantageous for development, and typically is called solution physical development. Anions that form silver salts with Ksp values greater than the Ksp value for AgBr, such as NH3, Ag ligands, and both linear and cyclic polyethers and polythioethers, would promote solution physical development.

It is preferred, but not required, that no lithium or magnesium ions are purposely added to the color developing compositions used in this invention. Depending upon the concentrations of such ions in water used to make up processing solutions, or carried over from previous processing baths, the total concentration (that is, the sum) of these ions remains preferably very low, that is less than 0.0001 mol/l in the compositions, and preferably a total of less than 0.00001 mol/l.

Exemplary color developing compositions and components are described, for example, in U.S. application Ser. No. 09/706,006 of Arcus et al, U.S. application Ser. No. 09/706,463 of Haye et al, and U.S. application Ser. No. 09/706,474 of Arcus et al, all filed Nov. 3, 2000, all incorporated herein for their teaching about color developing compositions.

The color developing composition is preferably formulated and used as an aqueous solution, either as the working developer solution or as a replenishing solution. They can be added to the processors as single-part solutions or multi-part solutions. They can also be formulated as gels, powders, and crystalline suspensions. They can also be formulated and used as dry tablets. The technology for this is readily known in the art, such as U.S. Pat. No. 5,362,610 (Yoshimoto), U.S. Pat. No. 5,376,509 (Yoshimoto et al), and EP 0 611 986 A1 (published Aug. 24, 1994).

Processing according to the present invention can be carried out using conventional deep tanks holding processing solutions or automatic processing machines. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein. Processing can also be carried out in minilabs.

Processing according to the present invention can be carried out using less conventional processors such as those described in U. S. Pat. Nos. 5,864,729; 5,890,028; or 5,960,227; a drum processor such as the Kodak RS-11 Drum Processor, or the wave processor described in U.S. application Ser. No. 09/920,495, filed Aug. 1, 2001, the disclosure of which is incorporated herein by reference. This is a small processor that uses small volumes of processing solutions once to process photographic material. It processes the material with only a few millilitres of processing solution which is then collected as waste. This processor processes a photographic material by loading the material into a chamber, introducing a metered amount of processing solution into the chamber, and rotating the chamber in a fashion which forms a wave in the solution through which the material passes, the whole volume of solution for a given stage being spread over the whole material area in a repetitive manner to enable uniform processing. The appropriate solution for each processing stage is added and removed sequentially from the processing space.

Another processor and processing method with which the current invention is particularly useful is the merged process described in U.S. application Ser. No. 10/012,673 of Twist, "Processing Photographic Material" filed on Oct. 30, 2001, the disclosure of which is incorporated herein by reference. This processing method for silver halide photographic material comprises loading the material into a chamber, introducing a metered amount of a first processing solution into the chamber, and processing the photographic material with the first processing solution. It then comprises introducing a metered amount of a second processing solution into the chamber without removing the first processing solution so that at least part of the whole volume of the second processing solution is provided by the first processing solution and processing the photographic material with the second processing solution. The merged method further comprises, after processing the photographic material with the second processing solution, introducing a metered amount of a third processing solution into the chamber without removing any processing solution remaining from the preceding processing solution or solutions so that at least part of the total volume of the third processing solution is provided by the preceding processing solution or solutions and processing the photographic material with the third processing solution.

Besides the component chemistry of the developer, the agitation and the mode of contact of the developer to the film can change the rapidity of development. Typically, the more agitation, the greater is the development speed more developer gets into the film and more development by-products (typically development inhibitors such as bromide, iodide), are removed from the film. Film agitation can involve one or more of the following: film movement through the developer, gas bubbles, mechanical agitation, pumping, rollers, wipers, ultrasonics, pads, rollers, dip and dunk, etc. The developer solutions can be replenished as in a minilab or deeptank processor, or can be single use, such as the above-described rotating chamber and the small, hand-held Nicor reels and tanks.

The silver bromoiodide elements of the invention are generally sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support.

The following examples are intended to illustrate, but not to limit the invention.

EXAMPLES

Example 1

Preparation of Film Samples

Sample 1: A multilayer photographic element was prepared by forming the following layers on a cellulose triacetate film support:

| | |
|---|---|
| Layer 1: Antihalation Layer | |
| Black colloid silver | 0.15 g/m$^2$ as silver |
| Gelatin | 1.61 g/m$^2$ |
| OxDS-1 | 0.081 |
| This layer also includes absorber dyes to ensure speed matches between layer responses. | |
| Layer 2: First Red Sensitive Emulsion Layer | |
| Silver Bromoiodide emulsion (1.5% iodide, mean grain size 0.55 × 0.083 μm) | 0.65 g/m$^2$ |
| Silver Bromoiodide emulsion (4.1% iodide, mean grain size 0.66 × 0.12 μm) | 0.48 |
| Coupler CC-1 | 0.55 |
| Coupler BA-1 | 0.086 |
| Coupler CD-1 | 0.034 |
| Gelatin | 0.79 |
| Layer 3: Second Red Sensitive Emulsion Layer | |
| Silver Bromoiodide emulsion (4.1% iodide, mean grain size 1.22 × 0.11 μm) | 0.34 g/m$^2$ |
| Silver Bromoiodide emulsion (4.1% iodide, mean grain size 1.07 × 0.114 μm) | 0.43 |
| Coupler CC-1 | 0.27 |
| Coupler CD-2 | 0.038 |
| Coupler CM-1 | 0.016 |
| Gelatin | 1.130 |
| Layer 4: Third Red Sensitive Emulsion Layer | |
| Silver Bromoiodide emulsion (0/3.7% iodide, mean grain size 1.42 × 0.132 μm) | 0.86 g/m$^2$ |
| Coupler CD-3 | 0.043 |
| Coupler CD-1 | 0.059 |
| Coupler CM-1 | 0.038 |
| Coupler CC-1 | 0.102 |
| Coupler CC-2 | 0.033 |
| Gelatin | 1.635 |
| Layer 5: Interlayer | |
| Gelatin | 0.54 g/m$^2$ |
| OxDS-1 | 0.081 |
| Layer 6: First Green Sensitive Emulsion Layer | |
| Silver Bromoiodide emulsion (0/4.5% iodide, mean grain size 0.57 × 0.111 μm) | 0.17 g/m$^2$ |
| Silver Bromoiodide emulsion (3.5% iodide, mean grain size 0.28 μm cube) | 0.29 |
| Silver Bromoiodide emulsion (0/3% iodide, mean grain size 0.46 × 0.114 μm) | 0.29 |
| Coupler MC-1 | 0.43 |
| Coupler MM-1 | 0.11 |
| Coupler MD-1 | 0.031 |
| Gelatin | 1.52 |
| Layer 7: Second Green Sensitive Emulsion Layer | |
| Silver Bromoiodide emulsion (0/4.5% iodide, mean grain size 0.75 × 0.126 μm) | 0.71 g/m$^2$ |
| Silver Bromoiodide emulsion (0/3% iodide, mean grain size 0.46 × 0.114 μm) | 0.15 |
| Coupler MC-1 | 0.25 |
| Coupler MM-1 | 0.12 |
| Coupler MD-1 | 0.024 |
| Coupler MD-2 | 0.027 |
| Gelatin | 1.45 |
| Layer 8: Third Green Sensitive Emulsion Layer | |
| Silver Bromoiodide emulsion (0/4.5% iodide, mean grain size 1.19 × 0.128 μm) | 0.77 g/m$^2$ |
| Coupler MC-1 | 0.11 |
| Coupler MM-1 | 0.03 |
| Coupler MD-2 | 0.036 |
| Coupler MD-3 | 0.003 |
| Gelatin | 0.94 |
| Layer 9: Yellow Filter Layer | |
| Gelatin | 0.54 g/m$^2$ |
| OxDS-1 | 0.075 |
| Dye YFD-1 | 0.10 |
| BI-1 | 0.043 |
| Layer 10: First Blue Sensitive Emulsion Layer | |
| Silver Bromoiodide emulsion (1.5% iodide, mean grain size 0.55 × 0.083 μm) | 0.18 g/m$^2$ |
| Silver Bromoiodide emulsion (1.5% iodide, mean grain size 0.77 × 0.14 μm) | 0.36 |
| Silver Bromoiodide emulsion (4.1% iodide, mean grain size 1.25 × 0.137 μm) | 0.32 |
| Coupler YC-1 | 0.70 |
| Coupler YC-2 | 0.43 |

-continued

| | |
|---|---|
| Coupler YD-1 | 0.16 |
| Coupler CD-2 | 0.022 |
| Coupler BA-1 | 0.005 |
| Gelatin | 2.23 |
| Layer 11: Second Blue Sensitive Emulsion Layer | |
| Silver Bromoiodide emulsion (4.1% iodide, mean grain size 1.25 × 0.137 μm) | 0.31 g/m$^2$ |
| Silver Bromoiodide emulsion (4.1% iodide, mean grain size 2.67 × 0.128 μm) | 0.31 |
| Coupler YC-1 | 0.26 |
| Coupler YD-1 | 0.13 |
| Coupler BA-1 | 0.005 |
| Gelatin | 2.22 |
| Layer 12: First Protective Layer | |
| Gelatin | 0.70 g/m$^2$ |
| Silver Bromide Lippmann emulsion | 0.22 |
| Dye UV-1 | 0.10 |
| Dye UV-2 | 0.10 |
| Layer 13: Second Protective Layer | |
| Gelatin | 0.89 g/m$^2$ |

Sample 2—as above except the concentration of CC-1 in Layer 3 was reduced to 0.10 mg/m$^2$ and ETARC compound C-1 was added to Layer 3 at 0.08 mg/m$^2$.

Sample 3—as Sample 2 except the concentration of CC-1 in Layer 2 was reduced to 0. 38 mg/m$^2$ and ETARC compound C-1 was added to Layer 2 at 0.08 mg/m$^2$.

Sample 4—as Sample 3 except CC-2 was removed from Layer 4 and ETARC compound C-1 was added to Layer 4 at 0.06 mg/m$^2$.

Sample 5—as Sample 1 except the concentration of CC-1 in Layer 2 was reduced to 0.38 mg/m$^2$ and ETARC compound C-1 was added to Layer 2 at 0.08 mg/m$^2$.

Sample 6—as Sample 1 except CC-2 was removed from Layer 4 and ETARC compound C-1 was added to Layer 4 at 0.06 mg/m$^2$.

Sample 7—as Sample 6 except CC-1 was removed from Layer 4 and the concentration of ETARC compound C-1 in Layer 4 was increased to 0.075 mg/m$^2$.

Sample 8—as Sample 1 except CC-2 was removed from Layer 4 and the concentration of CC-1 in Layer 4 was increased to 0.21 mg/m$^2$.

Sample 9—as Sample 8 except DA-1 was added to Layer 5 at 0.043 mg/m$^2$.

OxDS-1

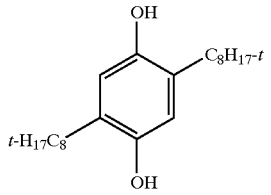

-continued

CC-1

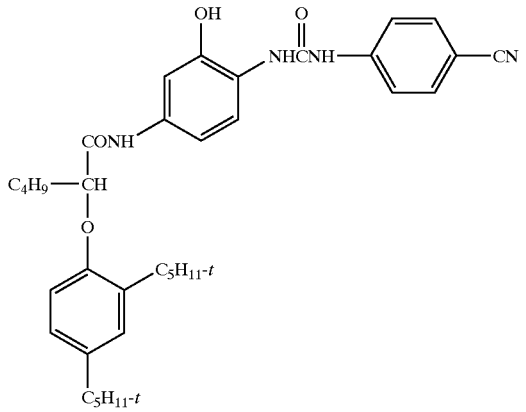

BA-1

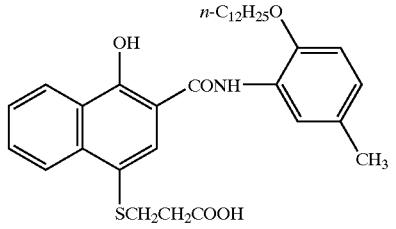

CD-1

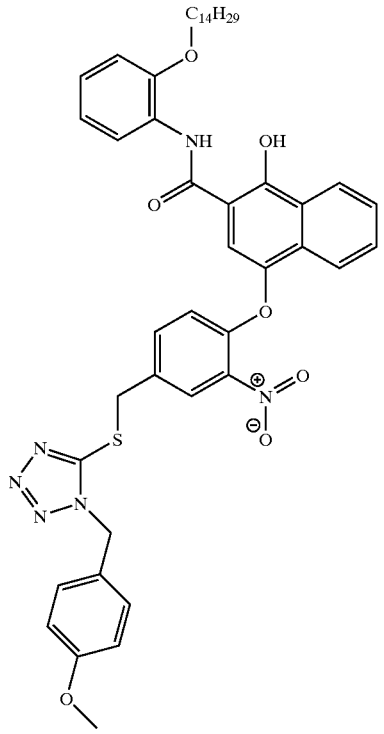

-continued
CD-2
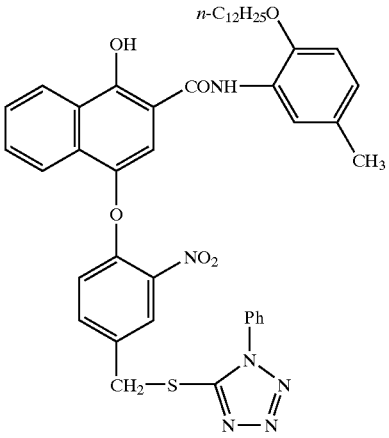
CM-1
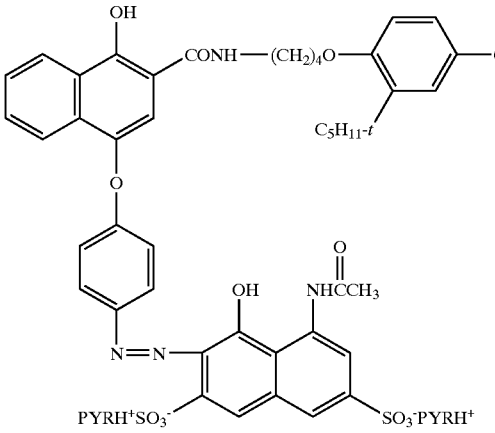
CD-3
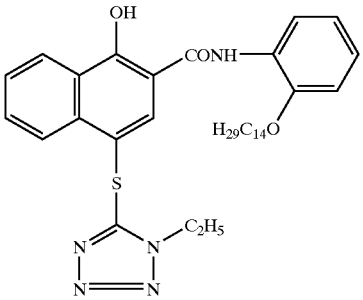
CC-2
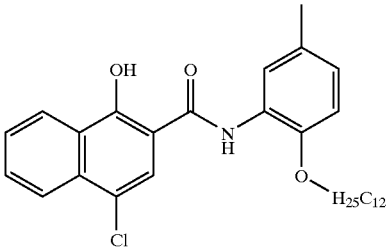
-continued
MC-1
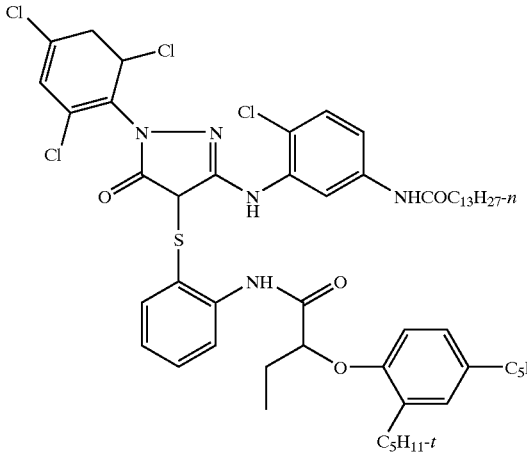
MM-1
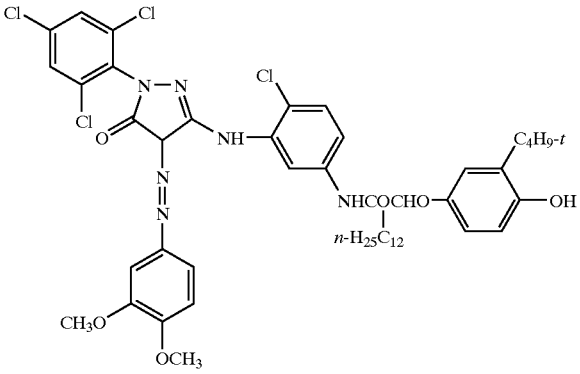
MD-1
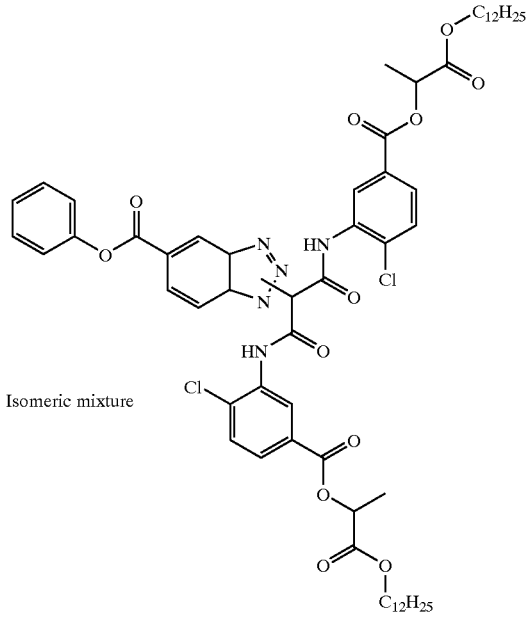
Isomeric mixture -continued
MD-2
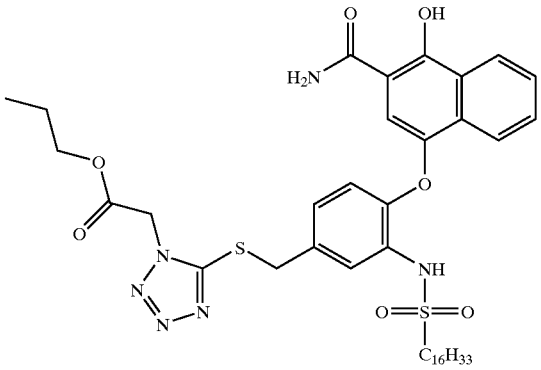
MD-3
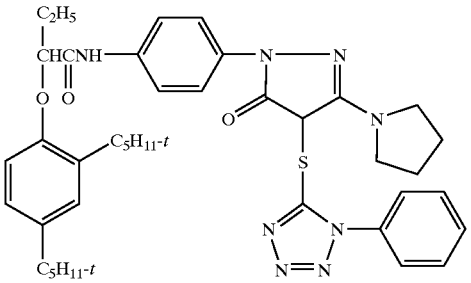
YFD-1
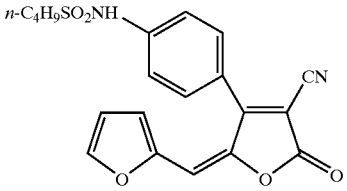
DA-1
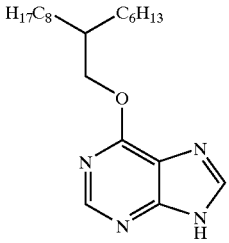
YC-1
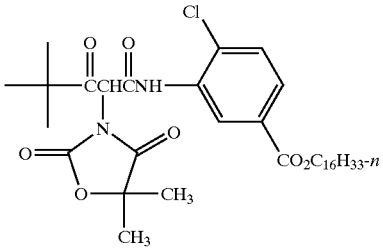
-continued
YC-2
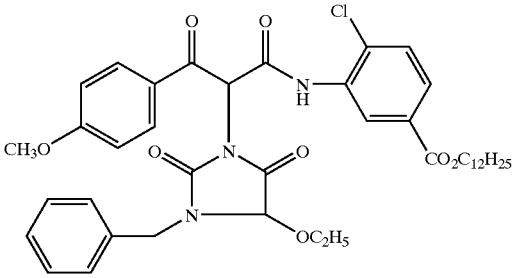
YD-1
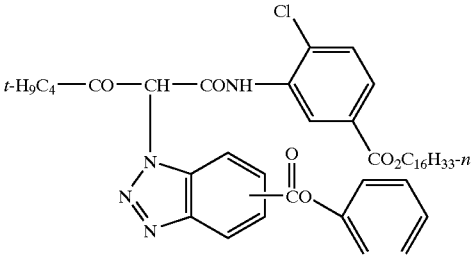
UV-1
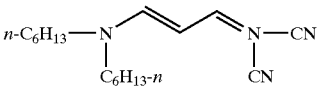
UV-2
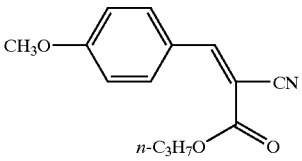
C-1
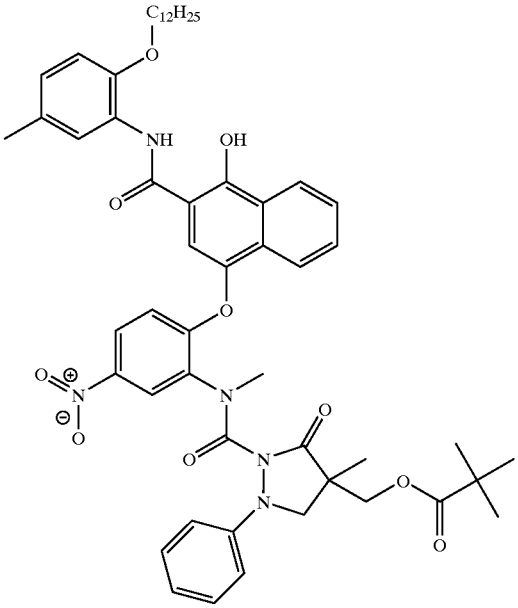

Example 2

The above samples were processed in a Konica rapid process which is commercially available under the name QD-21 Plus Digital Minilab, film process cycle "ECOJET HQA-N." and in the Kodak C-41 RA Process (See Example 3 for processing compositions).

TABLE 1

Comparison of Process C-41 and Process QD-21

| Solution | Time (Process QD-21) | Time (Process C-41 RA) |
|---|---|---|
| Developer | 1:40 | 3:15 |
| Bleach | 0:24 | 0:45 |
| Fixer | 0:47 | 1:30 |
| Stabilizer | 0:47 | 1:00 |

For each sample, the Lower Scale Contrast (LSC) of the red curve was measured from the point 0.15 in Status M density above the minimum density to a point with 0.4 Log H more exposure. The Mid Scale Contrast (MSC) of the red curve was measured from the point 0.4 Log H to 1.1 Log H more exposure from the point 0.15 in Status M density above the minimum density. The Status M density (above the minimum density) of the red record at 1.8 Log H from the point 0.15 in density above the minimum density was also measured (Over exposure density (OD)). Table 2 shows the above parameters for the samples processed in the QD-21 process. The numbers are calculated with respect to Sample 1.

TABLE 2

| Sample | Layer w/ETARC | % Change in LSC | % Change in MSC | % Change in OD |
|---|---|---|---|---|
| 1 | Comparative example | — | — | — |
| 2 | Layer 3 | 15.2 | 22.3 | 8.0 |
| 3 | Layer 2 + 3 | 15.0 | 27.7 | 13.0 |
| 4 | Layer 2 + 3 + 4 | 35.0 | 17.8 | 10.5 |
| 5 | Layer 2 | 6.1 | 5.7 | 10.3 |
| 6 | Layer 4 | 10.4 | 5.7 | 2.1 |

Comparison of Sample 6 to Sample 1 and Sample 4 to Sample 3 demonstrates that the primary effect of adding the ETARC to Layer 4 is a change in contrast in the lower scale. Similarly, comparison of Sample 3 to Sample 2 and Sample 5 to Sample 1 demonstrates that the primary effect of adding the ETARC to Layer 2 is a change in increase in OD, and a smaller effect in LSC than adding the ETARC to Layer 4. Comparison of Sample 2 to Sample 1 and Sample 2 to Samples 5 and 6 demonstrates that the MSC is changed more and the LSC and OD changed less by adding the ETARC to Layer 3 than Layer 2 or 4. Thus, by controlling the level and placement of the ETARC in a specific layer, the LSC, MSC, and OD of the red sensitive layers in the rapid process can be selectively adjusted to be more similar to the green and-blue sensitive layers.

Table 3 shows the change in MSC and OD for the various samples in the QD-21 process when compared to the standard C-41 process. The numbers are calculated with respect to each sample in the C-41 process.

TABLE 3

| Sample | Layer w/ETARC | % Change in MSC | % Change in OD |
|---|---|---|---|
| 1 | Comparative example | −15.2 | −16.4 |
| 2 | Layer 3 | −9.4 | −12.0 |
| 3 | Layer 2 + 3 | −11.6 | −11.8 |
| 4 | Layer 2 + 3 + 4 | −10.0 | −8.8 |
| 5 | Layer 2 | −15.7 | −15.2 |
| 6 | Layer 4 | −11.6 | −14.3 |

The above table shows that the loss of contrast and OD in the rapid access QD-21 process compared to the C-41 process can also be lessened by proper placement of the ETARC.

Example 3

Some of the above film samples were processed as follows in two different rapid process developers and in a comparative process, the KODAK C-41 Process. The KODAK C-41 Rapid Access Process steps of bleaching through final rinse were used for all three processes.

TABLE 4

| Dev. Type<br>Time (sec)<br>pH<br>Temp | | MW | RP Dev H<br>(60)<br>10.1<br>48° C.<br>gm/l | RP Dev N<br>(60)<br>10.42<br>44.6° C.<br>gm/l | C-41<br>(195)<br>10.07<br>37.78 C.<br>gm/l |
|---|---|---|---|---|---|
| HAS | Hydroxylamine sulfate | 164.14 | 3.0 | 3.0 | 3.0 |
| Antical-8 | Diethylenetriamine pentaacetic acid, sodium salt | 503.26 | 2.6 | 2.6 | 2.6 |
| KI | Potassium iodide | 166 | 0.004 | 0.004 | 0.0012 |
| PVP(mer) | Poly(vinyl pyrrolidone) | 111.14 | 3.0 | 3.0 | none |
| NaBr | Sodium bromide | 102.9 | none | none | 1.3 |
| KBr | Potassium bromide | 119.01 | 2 | 2 | none |
| $K_2CO_3$ | Potassium carbonate | 138.21 | 40 | 40 | 37.5 |
| CD-4 | 4-(N-ethyl-N-2-hydroxy-ethyl)-2-methylphenylene-diamine sulfate | 292.35 | 14.0 | 17.15 | 4.5 |
| $K_2CO_3$ | Potassium sulfite | 158 | 9.0 | 10.0 | none |
| $Na_2SO_3$ | Sodium sulfite | 126.04 | none | none | 4.0 |

Rapid Process (RP)

| Step | Time* | Agitation |
|---|---|---|

TABLE 4-continued

| | | |
|---|---|---|
| Rapid process developer | 55 + 5 | Nitrogen burst, 2 sec. on, 4 sec. Off |
| Kodak C-41 RA bleach | 40 + 5 | Continuous air bubbles |
| Wash | 25 + 5 | Continuous air bubbles |
| Kodak C-41 RA fixer | 85 + 5 | Continuous air bubbles |
| Wash | 25 + 5 | Continuous air bubbles |
| Kodak photoflo rinse | 55 + 5 | None |

*Development time is 55 seconds in the sinkline tank and a 5 second drain and hold above the tank, before dropping the film racks into the next tank on the sheet).

| Constituent | Concentration |
|---|---|
| Chemical Composition of C-41RA bleach, prepared from replenisher (6.6 L solution 5940A1, diluted to 8 L and pH adjusted). | |
| PDTA (306.277) | 0.3709 M = 113.60 g/L |
| Anti-cal 3 (2-OH-PDTA) | 2.96 mM = 0.953 g/L |
| Glacial acetic acid | 0.8576 M = 51.49 g/L |
| Ammonium bromide | 0.967 M = 94.67 g/L |
| Ferric nitrate nonahydrate | 0.3389 M = 136.93 g/L |
| Ammonium hydroxide | to pH 4.50 |
| Chemical composition of C-41RA fixer, prepared from concentrate (4.0 L solution 5784A0, diluted to 8 L and pH adjusted. | |
| Ammonium triosulfate (148.20) | 0.7615 M = 112.85 g/L |
| Ammonium sulfite (116.14) | 68.79 mM = 7.990 g/L |
| Sodium sulfite (126.04) | 0.1111 M = 14 g/L |
| Ammonium thiocyanate (76.12) | 1.182 M = 90 g/L |
| $Na_2EDTA.2H_2O$ | 3.24 mM = 1.2 g |
| Glacial acetic acid | 12.82 mM = 0.77 g/L |
| Ammonium hydroxide or sulfuric acid | to pH 6.20 |

The changes in LSC, MSC, and OD for the two rapid process developers are given in Table 5. The numbers are calculated with respect to Sample 1.

TABLE 5

| Sample | Layer w/ETARC | % Change in LSC | % Change in MSC | % Change in OD |
|---|---|---|---|---|
| RP Dev H | | | | |
| 1 | Comparative example | — | — | — |
| 4 | Layer 2 + 3 + 4 | 33.4 | 17.1 | 11.1 |
| 6 | Layer 4 | 16.9 | 2.4 | 0.4 |
| RP Dev N | | | | |
| 1 | Comparative example | — | — | — |
| 4 | FC + MC + SC | 34.3 | 18.2 | 15.0 |
| 6 | FC | 11.3 | 2.9 | 3.1 |

Comparison on Samples 4 and 6 demonstrate that the placement of the ETARC effects different parts of the curve.

Table 6 shows the change in MSC and OD for the various samples in the two rapid access processes when compared to the standard C-41 process. The numbers are calculated with respect to each sample in the C-41 process.

TABLE 6

| Sample | Layer w/ETARC | % Change in MSC | % Change in OD |
|---|---|---|---|
| RP Dev H | | | |
| 1 | Comparative example | 14.7 | 18.1 |
| 4 | Layer 2 + 3 + 4 | 10.0 | 10.1 |
| 6 | Layer 4 | 13.9 | 17.4 |

TABLE 6-continued

| Sample | Layer w/ETARC | % Change in MSC | % Change in OD |
|---|---|---|---|
| RP Dev N | | | |
| 1 | Comparative example | 24.6 | 26.4 |
| 4 | FC + MC + SC | 19.6 | 16.4 |
| 6 | FC | 23.5 | 23.7 |

The above table shows that the loss of contrast and OD in the rapid access processes compared to the C-41 process can also be lessened by proper placement of the ETARC.

The invention has been described in detail with particular reference to the preferred embodiments thereof, but it will be understood that variations and modifications can be effected within the scope of the invention.

What is claimed is:

1. A method of processing a silver bromoiodide photographic element comprising contacting the photographic element with a color developer for 20 to 120 seconds; wherein the photographic element comprises a support and more than one dye forming unit, and wherein the least light sensitive layer of the dye forming unit closest to the support contains about 6 $\mu$mole/m$^2$ to about 500 $\mu$mole/m$^2$ of an electron transfer agent releasing compound represented by the formula:

$$\text{CAR-(L)}_n\text{-ETA}$$

wherein:

CAR is a carrier moiety which is capable of releasing -(L)$_n$-ETA on reaction with oxidized developing agent;

L is a divalent linking group, with the proviso that L is not —O —CO—; n is 0, 1, or 2; and ETA is a releasable 1-aryl-3-pyrazolidinone electron transfer agent having a calculated log partition coefficient (c log P) greater than or equal to 2.40 bonded to L or CAR through either the nitrogen atom in the 2-position or the oxygen attached to the 3-position of the pyrazolidinone ring.

2. The method of claim 1 wherein ETA is represented by Formulas I or II

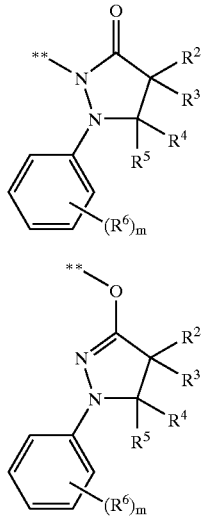

**denotes point of attachment to CAR-$(L)_n$-;

wherein:

$R^2$ and $R^3$ each independently represents hydrogen, a substituted or unsubstituted alkyl group having from 1 to 12 carbon atoms, $CH_2OR^7$ or $CH_2OC(O)R^7$ where $R^7$ is a substituted or unsubstituted alkyl, aryl, or a heteroatom containing group;

$R^4$ and $R^5$ each independently represents hydrogen, a substituted or unsubstituted alkyl group having from 1 to 8 carbon atoms or a substituted or unsubstituted aryl group having from 6 to 10 carbon atoms;

$R^6$ is a substituent; and m is 0 to 5; wherein when m is greater than 1, the $R^6$ substituents may form a carbocyclic or heterocyclic ring.

3. The method of claim 2 wherein $R^2$ and $R^3$ are independently alkyl, $CH_2OR^7$ or $CH_2OC(O)R^7$ groups containing 3 to 8 carbon atoms; $R^4$ and $R^5$ are hydrogen, $R^6$ is independently a halogen, a substituted or unsubstituted alkyl group having from 1 to 8 carbon atoms, a substituted or unsubstituted alkoxy group having from 1 to 8 carbon atoms, an amido, sulfonamido, ester, cyano, sulfone, carbamoyl, uriedo group, or a heteroatom containing group or ring.

4. The method of claim 2 wherein $R^4$ and $R^5$ are hydrogen; and $R^2$, $R^3$, and $R^6$ are as represented in the following table:

TABLE

| ETA No. | $R^2$ | $R^3$ | $R^6$ |
|---|---|---|---|
| 1 | $CH_3$ | $CH_2OC(O)iPr$ | H |
| 2 | $CH_3$ | $CH_2OC(O)tBu$ | H |
| 3 | $CH_3$ | $CH_2OC(O)Et$ | p-$CH_3$ |
| 4 | $CH_3$ | $CH_2OC(O)Et$ | 3,4-dimethyl |
| 5 | H | $CH_2OC_4H_9$-n | p-$OCH_3$ |
| 6 | $CH_3$ | $CH_2OC(O)CH_2$—O—$(CH_2)_2S(CH_2)_2SMe$ | H |

5. The method of claim 1 wherein CAR is a coupler moiety.

6. The method of claim 5 wherein the coupler moiety is a phenol or naphthol coupler moiety.

7. The method of claim 6 wherein the coupler moiety is represented by the structures:

I

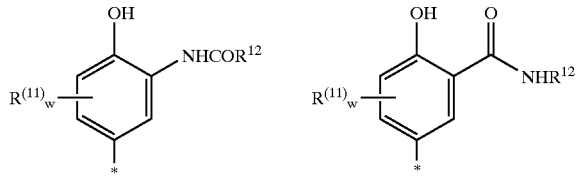

II

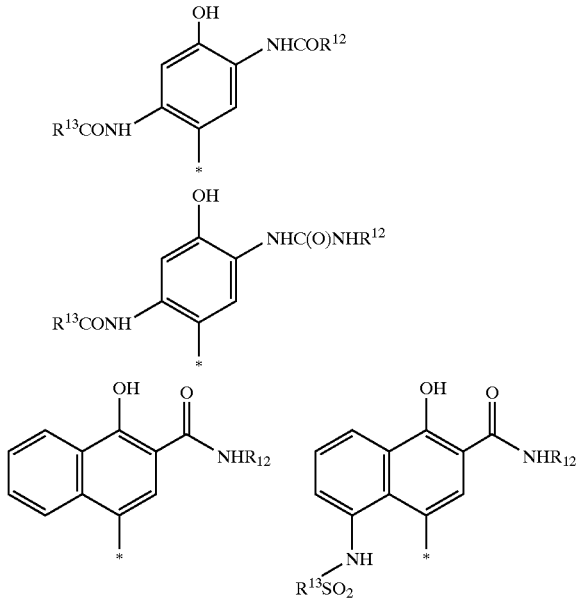

*denotes link to -$(L)_n$-ETA where $R^{12}$ and $R^{13}$ are independently a ballast group, a hydrogen, or a substituted or unsubstituted alkyl or aryl group, $R^{11}$ is a halogen atom, an alkyl group having from 1 to 4 carbon atoms or an alkoxy group having from 1 to 4 carbon atoms, and w is 1 or 2.

8. The method of claim 1 wherein the ETA has a calculated log partition coefficient (c log P) between and including 2.40 and 3.50.

9. The method of claim 1 wherein the dye forming unit closest to the support is the red dye forming unit.

10. The method of claim 1 wherein the silver bromoiodide photographic element is contacted with the color developer for 100 seconds or less.

11. The method of claim 1 wherein the silver bromoiodide photographic element is contacted with the color developer for 60 seconds or less.

12. A method of processing a silver bromoiodide photographic element comprising contacting the photographic element with a color developer for 20 to 100 seconds; wherein the photographic element comprises a support and more than one dye forming unit, and wherein the least sensitive layer of the dye forming unit closest to the support contains about 6 $\mu$mole/$m^2$ to about 500 $\mu$mole/$m^2$ of an electron transfer agent releasing compound represented by the formula:

CAR-$(L)_n$-ETA wherein:

CAR is a coupler moiety which is capable of releasing -$(L)_n$-ETA on reaction with oxidized developing agent;

L is a divalent linking group, with the proviso that L is not —O—CO—; n is 0, 1, or 2; and ETA is a releasable 1-aryl-3-pyrazolidinone electron transfer agent having a calculated log partition coefficient (c log P) greater than or equal to 2.40 wherein ETA is represented by the formulas:

I

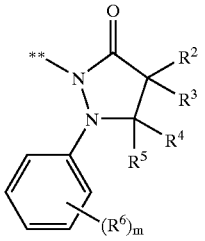

II

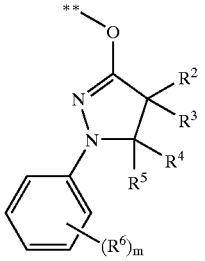

**denotes point of attachment to CAR-$(L)_n$-;

wherein: $R^2$ and $R^3$ each independently represents hydrogen, a substituted or unsubstituted alkyl group having from 1 to 12 carbon atoms, $CH_2OR^7$ or $CH_2OC(O)R^7$ where $R^7$ is a substituted or unsubstituted alkyl, aryl or a heteroatom containing group;

$R^4$ and $R^5$ each independently represents hydrogen, a substituted or unsubstituted alkyl group having from 1 to 8 carbon atoms or a substituted or unsubstituted aryl group having from 6 to 10 carbon atoms;

$R^6$ is independently a substituent; and m is 0 to 5 wherein when m is greater than 1, the $R^6$ substituents may form a carbocyclic or heterocyclic ring.

13. The photographic element of claim 12 wherein R2 and R3 are independently alkyl, CH2OR7 or CH2OC(O)R7 groups containing 3 to 8 carbon atoms; R4 and R5 are hydrogen; and R6 is independently a halogen, a substituted or unsubstituted alkyl group having from 1 to 8 carbon atoms, a substituted or unsubstituted alkoxy group having from 1 to 8 carbon atoms, an amido, sulfonamido, ester, cyano, sulfone, carbamoyl, uriedo group, or a heteroatom containing group or ring.

14. The photographic element of claim 12 wherein $R^4$ and $R^5$ are hydrogen; and $R^2$, $R^3$ and $R^6$ are as represented in the following Table:

TABLE

| ETA No. | $R^2$ | $R^3$ | $R^6$ |
|---|---|---|---|
| 1 | $CH_3$ | $CH_2OC(O)iPr$ | H |
| 2 | $CH_3$ | $CH_2OC(O)tBu$ | H |
| 3 | $CH_3$ | $CH_2OC(O)Et$ | p-$CH_3$ |
| 4 | $CH_3$ | $CH_2OC(O)Et$ | 3,4-dimethyl |
| 5 | H | $CH_2OC_4H_{9-n}$ | p-$OCH_3$ |
| 6 | $CH_3$ | $CH_2OC(O)CH_2$—O—$(CH_2)_2S(CH_2)_2SMe$ | H |

15. The method of claim 12 wherein the coupler moiety is a phenol or naphthol coupler moiety.

16. The method of claim 12 wherein the dye forming unit closest to the support is the red dye forming unit.

17. The photographic element of claim 16 wherein the ETA has a calculated log partition coefficient (c log P) between and including 2.40 and 3.50.

18. The method of claim 12 wherein the electron transfer agent releasing compound is contained in the least light sensitive layer of the dye forming unit.

19. The method of claim 12 wherein the silver bromoiodide photographic element is contacted with the color developer for 60 seconds or less.

20. The method of claim 1 wherein the dye forming unit closest to the support contains a development inhibitor releasing compound.

21. The method of claim 12 wherein the dye forming unit closest to the support contains a development inhibitor releasing compound.

* * * * *